US005849651A

United States Patent [19]

Takayama et al.

[11] Patent Number: 5,849,651

[45] Date of Patent: Dec. 15, 1998

[54] REVERSIBLE THERMAL RECORDING MEDIUM

[75] Inventors: Satoshi Takayama, Kawasaki; Sawako Fujioka, Tokyo; Tetsuo Okuyama, Yokohama; Hideyuki Nishizawa, Tokyo; Hirohisa Miyamoto, Kawasaki; Masami Sugiuchi, Yokohama, all of Japan

[73] Assignee: Kabushiki Kaisha Toshiba, Kawasaki, Japan

[21] Appl. No.: 656,486

[22] Filed: May 31, 1996

[30] Foreign Application Priority Data

| | | | |
|---|---|---|---|
| Jun. 1, 1995 | [JP] | Japan | 7-134616 |
| Jul. 5, 1995 | [JP] | Japan | 7-169873 |
| Jul. 5, 1995 | [JP] | Japan | 7-169961 |

[51] Int. Cl.[6] ..... B41M 5/34

[52] U.S. Cl. ..... 501/201; 503/204; 503/208; 503/209; 503/216; 503/217

[58] Field of Search ..... 503/201, 209, 503/216, 217, 204, 208; 427/150

[56] References Cited

U.S. PATENT DOCUMENTS 5,296,439 3/1994 Maruyama et al. ..... 503/201

OTHER PUBLICATIONS

Katsuyuki Naito, "Amorphous–Crystal Transition of Organic Dye Assemblies: Application to Rewritable Color Recording Media", Appl. Phys. Lett., vol. 67, (pp. 211–213), Jul. 10, 1995.

Yasuro Yokota, et al., "Rewritable Thermal Recording Material", Japan Hardcopy, 1993.

*Primary Examiner*—Bruce H. Hess

*Attorney, Agent, or Firm*—Oblon, Spivak, McClelland, Maier & Neustadt, P.C.

[57] ABSTRACT

A reversible thermal recording medium comprises a composition containing a color former, a developer, a reversible material capable of reversibly changing the state of the composition by supplying heat energies with two different values, and, as required, a phase separation controller which permits changing the phase separation speed of the developer at temperatures in the vicinity of the melting point of the phase separation controller, at least 80% by weight of the reversible material being a sterol compound in which the carbon-to-carbon bond between 2- and 3-positions of the stroid skeleton is a single bond, the carbon-to-carbon bond between 3- and 4-positions of the steroid skeleton is a single bond, a hydroxyl group is attached to the carbon atom in at least the 3-position of the steroid skeleton, and a specified chemical structure is bonded at 16- and 17-positions of the stroid skeleton, and the phase separation controller being provided by a low molecular organic material, the maximum carbon chain length there of being at least 10.

24 Claims, 9 Drawing Sheets

REVERSIBLE THERMAL RECORDING MEDIUM

BACKGROUND OF THE INVENTION

1. Field of the Invention

The present invention relates to a reversible thermal recording medium capable of reversibly writing and erasing images.

2. Description of the Related Art

In recent years, with the advance of office automation, the amount of various information has significantly increased, and the chances of information output have also been increased with increase in the information amount. In general, the information outputs are classified into a hard copy output from a printer to paper sheets and a display output. Unfortunately, in the hard copy output, a large quantity of paper is consumed as a recording medium with increase in the information output amount. Therefore, the hard copy output is expected to be a problem in the future in respect of protection of natural resources. On the other hand, the display output requires a large scale circuit board in a display unit. This brings about problems of portability and cost. For these reasons, a rewritable recording (or marking) medium capable of reversibly recording and erasing display images, which is free from the above-noted problems inherent in the conventional technique, is anticipated as a third recording medium. The rewritable recording medium is a solid or semi-solid recording medium which permits reversibly recording and erasing images of a high clarity a large number of times and which does not require an energy for retaining the display.

A low molecular organic material-high molecular resin matrix system, in which a thermal printer head (TPH) can be used for changing the state of the low molecular organic material within the high molecular resin matrix to perform the recording and erasing of images, is known as such a rewritable recording medium, as described in, for example, Japanese Patent Disclosure (Kokai) No. 55-154198 and Japanese Patent Disclosure No. 57-82086. The conventional system of this type exhibits various characteristics as a rewritable recording medium in a good balance and has begun to be practically used in some kinds of prepaid cards. However, in the conventional low molecular organic material-high molecular resin matrix system, the range of environmental temperatures within which images can be recorded and erased in a short time using a TPH is narrow. In addition, the number of recording-erasing cycles achieved by this conventional system is relatively small, i.e., about 150 to 500. As a result, the technical field to which the rewritable recording medium of this type can be applied is markedly limited. For example, it is difficult to use the particular rewritable recording medium in the manufacture of IO (Input-Output) cards for train stations because the cards are subjected to a wide range of environmental temperatures. Further, reversible changes between the slightly opaque state and the transparent state are achieved in the low molecular organic material-high molecular resin matrix system known to the art, with the result that it is difficult to recognize clearly and sufficiently the displayed images.

Some recording media in which reversible changes are achieved between the color developed state and the decolored state are certainly known to the art. For example, Japanese Patent Disclosure No. 4-50290 discloses recording materials which contain a leuco dye, an acid as a developer, and a long-chain amine as a decoloring agent, and in which heat energy is supplied to the recording material so as to repeatedly perform the chemical color development and decoloring. Additional recording materials, which contain a leuco dye and a long-chain phosphonic acid as a developer and in which the heat energy is controlled so as to change the crystal structure and, thus, to achieve reversible changes between the color developed state and the decolored state, are disclosed in, for example, the 42nd Polymer Forum Preprints, 1993, page 2736, Japanese Patent Disclosure No. 4-247985, Japanese Patent Disclosure No. 4-308790 and Japanese Patent Disclosure No. 4-344287. Further, "Japan Hardcopy '93, pp 413-416" teaches an additional type of recording material, which contains a leuco dye and a long-chain 4-hydroxyanilide compound which is highly crystallizable and in which reversible changes between the color developed state and the decolored state are achieved, by supplying heat energy, on the basis of reversible changes between the crystalline state and amorphous state.

However, it is generally impossible to obtain a colorless and transparent decolored state in the conventional recording materials described above, making it difficult to achieve a high contrast ratio between the color developed state and the decolored state. In addition, it is also difficult to utilize the display of the background. What should also be noted is that the color is changed gradually, if the recording material is stored or used under high environmental temperatures, leading to an insufficient thermal stability. Further, two kinds of heat histories consisting of a rapid cooling and a gradual cooling after the heating are given to the conventional recording material noted above so as to control the color developed state and the decolored state. For achieving the particular control, a TPH or a laser is used as a heat source in the process requiring a rapid cooling. On the other hand, a hot stamper or a heat roller is used as a heat source in the process requiring a gradual cooling. In short, at least two kinds of heating devices are used in the conventional color developing-decoloring type rewritable recording medium. In addition, the conventional recording medium is defective in that the gradual cooling takes a long time.

Further, Ni complex compounds are disclosed as a material whose colored state is changed in accordance with the reversible change between the crystalline state and the amorphous state in "Mol. Cryst. liquid Cryst., 1993, 235, page 147". However, since the recording material of this type is colored green under the crystalline state and colored red under the amorphous state, it is difficult to achieve display excellent in contrast ratio.

SUMMARY OF THE INVENTION

An object of the present invention is to provide a reversible thermal recording medium which requires only one heating device for both recording and erasing images, which permits each of the color development and decoloring at a high speed, and which exhibits a good thermal stability.

According to a first aspect of the present invention, there is provided a reversible thermal recording medium, comprising a composition containing a color former, a developer, and a reversible material capable of reversibly changing the state of said composition by supplying heat energies with two different values or by providing two different heat histories, at least 80% by weight of said reversible material being a sterol compound in which the carbon-to-carbon bond between 2- and 3-positions of the stroid skeleton represented by structural formula (1) given below is a single bond, the carbon-to-carbon bond between 3- and 4-positions of said steroid skeleton is a single bond, a hydroxyl group is attached to the carbon atom in at least the 3-position of the steroid skeleton, and one of chemical structures (A) to (D) given below is bonded at 16- and 17-positions of the stroid skeleton:

(1)

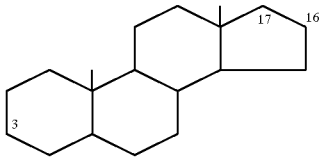

(steroid skelton)

(A)

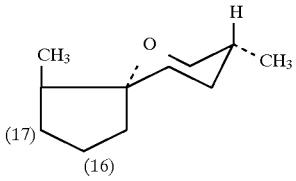

(B)

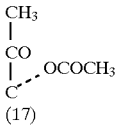

(C)

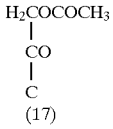

(D)

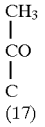

According to a second aspect of the present invention, there is provided a reversible thermal recording medium, comprising a composition containing a color former, a developer, and a phase separation controller which permits changing the phase separation speed between said color former and/or said developer at temperatures in the vicinity of the melting point thereof, said phase separation controller being provided by a low-molecular organic material, the maximum carbon chain length included in said organic material being at least 10.

According to a third aspect of the present invention, there is provided a reversible thermal recording medium, comprising a composition containing a color former, a developer, and a reversible material, said reversible material being provided by a benzophenone compound represented by general formula (2) given below:

(2)

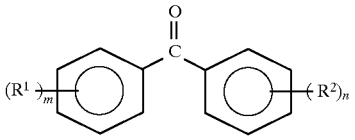

where $R^1$ and $R^2$, which are the same or different, are selected from the group consisting of a halogen atom, an alkyl group, an alkoxyl group, an amino group and a hydroxyl group, and m and n, which are the same or different, denote integers of 0 to 5, at least one of $R^1$ and $R^2$ being a hydroxyl group, and at least one of m and n not being zero.

Further, according to a fourth aspect of the present invention, there is provided a reversible thermal recording medium, comprising a composition containing a color former, a developer, a reversible material, and a phase separation controller, the difference between the melting point and the solidifying point of said phase separation controller being at least 10° C.

DETAILED DESCRIPTION OF THE PREFERRED EMBODIMENTS

Figure 1:
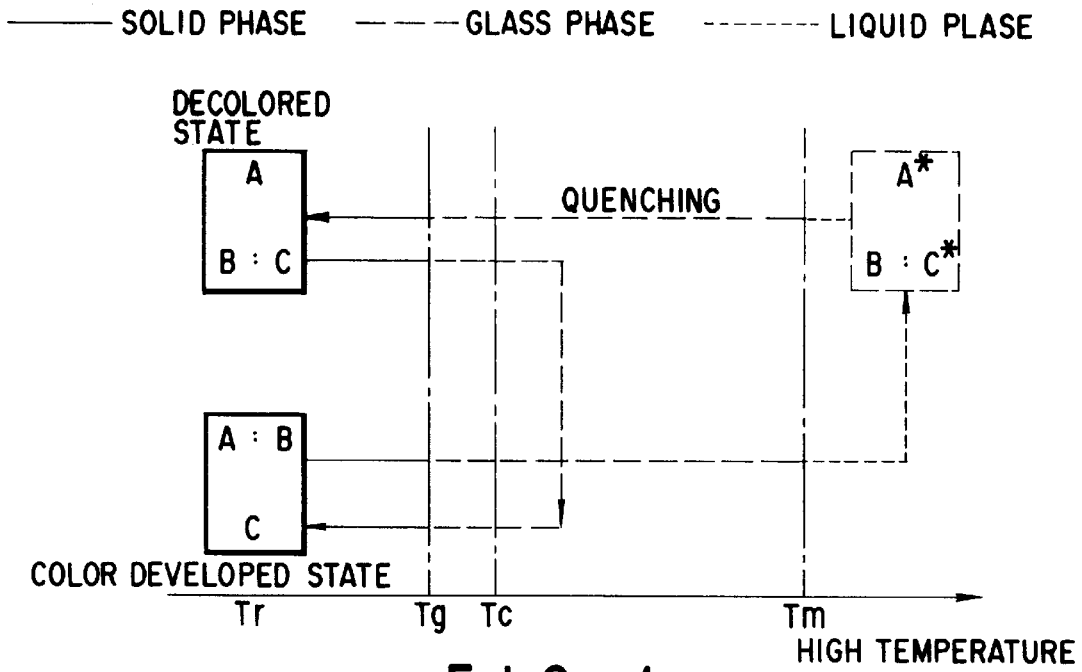
FIG. 1 shows the operating principle of a reversible thermal recording material of the present invention, which is of a three-component system consisting of a color former, a developer and a reversible material.

First, functions of basic components constituting the recording medium of the present invention and operation principle of the recording medium will be described. In a general sense, the color former denotes a precursor compound of a coloring matter which forms a display image, and a developer is a compound which changes the colored state of the color former by the interaction (primary exchange of an electron or proton) between the developer and the color former. That is, the combination of a color former and a developer generally means a combination of two types of compounds which develop a color when the interaction between them increases and loses a color when the interaction decreases. In the present invention, the terms "color former" and "developer" should be interpreted in a broad sense, although the above restricted meanings are naturally included. To be more specific, the present invention includes a combination of two types of compounds (in a narrow sense, a coloring matter and a decoloring agent) which are deprived of a color when the interaction between the two increases and develop a color when the interaction decreases. For the sake of simplicity of description, however, the following description will mainly be directed to the combination of a color former and a developer in the former narrow sense. The combination of a coloring matter and a decoloring agent in the latter sense will be discussed on occasion as a supplementary description.

The reversible material used in the present invention is an organic compound of a low molecular weight which affects the reversible change in states of the composition of a three component system consisting of a color former, a developer and a reversible material. Where the three component system is in a fluidized state, the reversible material preferentially dissolves the developer (or the color former). On the other hand, where the three component system is in a solidified state, it is possible for the composition to assume at least two states, i.e., state of equilibrium and state of nonequilibrium, of long life given below:

(1) (Equilibrium State). The reversible material dissolves the color former and the developer to reach an equilibrium in solubility, and the color former and the developer in excess of the equilibrium are separated from the reversible material to form phases differing from the phase of the reversible material. As a result, the interaction between the color former and the developer is increased so as to develop a color.

(2) (Nonequilibrium State). The reversible material dissolves a large amount of the developer (or the color former) in excess of equilibrium in solubility, with the result that the interaction between the color former and the developer is decreased to provide a decolored state.

The nonequilibrium state in item (2) is metastable or unstable, compared with the equilibrium state in item (1). However, the particular nonequilibrium state exhibits a sufficiently long life at room temperature.

If heat energies of two different values are supplied to the three component system of the present invention, or if the system is subjected to two different heat histories, the system exhibits a reversible change between the equilibrium state and the nonequilibrium state. The reversible change between the two different states can also be brought about by giving a change in stress to the three component system of the present invention.

Each of the equilibrium state in item (1) and the nonequilibrium state in item (2) may be either crystalline or amorphous. It follows that the change in the state of the three component system covers the changes from the crystalline to amorphous state, from the amorphous to amorphous state, and from the crystalline to crystalline state. The required properties of the reversible material are not particularly limited in the present invention. Where, for example, the reversible material is capable of assuming either the crystalline state or the amorphous state, the color developed state represents in general the state that the color former and the developer are segregated by phase separation around the grain boundaries of the reversible material. On the other hand, the decolored state represents the amorphous state in which the developer (or the color former) and the reversible material are dissolved in each other. Where the reversible material is highly crystallizable, the color developed state represents the state in which the color former and the developer are segregated around the grain boundaries of the reversible material, as described above. Further, the decolored state represents the state in which a mixed crystal is formed by the developer (or the color former) and the reversible material to form a mixed crystal phase which is substantially separate from the color former phase (or the developer phase), with the result that the interaction between the color former and the developer is decreased. It is desirable for the reversible material alone or combination of the reversible material and the developer (or the color former) to be capable of forming either as a crystalline phase or as an amorphous phase.

FIG. 1 schematically illustrates a typical color developing-decoloring mechanism in the three component system of the present invention consisting of the color former A, the developer B and the reversible material C described above. The drawing covers the case where the developer B exhibits a high solubility in the reversible material C in the melting step of the composition. The colon ":" in FIG. 1 denotes the state of interaction or mutual dissolution, with the asterisk "*" denoting a fluidized state.

At room temperature Tr, the color developed state, in which a mixed phase of the color former A and developer B is separated from the phase of the reversible material C, is close to equilibrium in terms of solubility. When the particular three component system is heated from this state to temperatures not lower than the melting point Tm of the system, the developer B and the reversible material C in a fluidized state are dissolved in each other. As a result, the interaction between the developer B and the color former A is lost, leading to decoloring. If the system is forcedly solidified by quenching from the molten state, the reversible material C takes the developer B into itself in an amount exceeding the equilibrium solubility. As a result, the system is turned amorphous and colorless at room temperature. The amorphous state under nonequilibrium exhibits a long life at temperatures not higher than the glass transition temperature Tg. If Tg is not lower than room temperature, it is substantially impossible for the nonequilibrium state to be converted into the equilibrium state.

If the three component system of the present invention, which is amorphous and in nonequilibrium, is heated to temperatures exceeding the glass transition point, the diffusion speed of the developer B within the system is rapidly increased. As a result, the phase separation of the developer B and the reversible material C is accelerated toward the original state of equilibrium. Under temperatures within which the color development owing to the phase separation can be sufficiently achieved in a predetermined period of time, the separated phases of the developer B and the reversible material C are rapidly crystallized. It follows that it is reasonable to understand that the crystallization temperature Tc provides the lower limit of the color developing temperature. The three component system which maintained a temperature falling within the range between the crystallization temperature and the melting point for a predetermined period of time assumes a more stable state of phase separation, which is closer to the state of equilibrium, so as to be put under a color developing state. It follows that it is possible to reversibly repeat the phase change between the phase of equilibrium and the phase of nonequilibrium so as to repeat the color developed state and the decolored state by supplying appropriately heat energies of two different values such that the reversible material can be heated to temperatures between the crystallization temperature Tc and the melting point Tm and to the temperatures higher than the melting point Tm. Strictly speaking, since the color developed state depends on the equilibrium solubility or state of the developer (or color former), it is necessary to take it into consideration that the density of the color development is affected by the heating temperature and the heating time.

Figure 2:
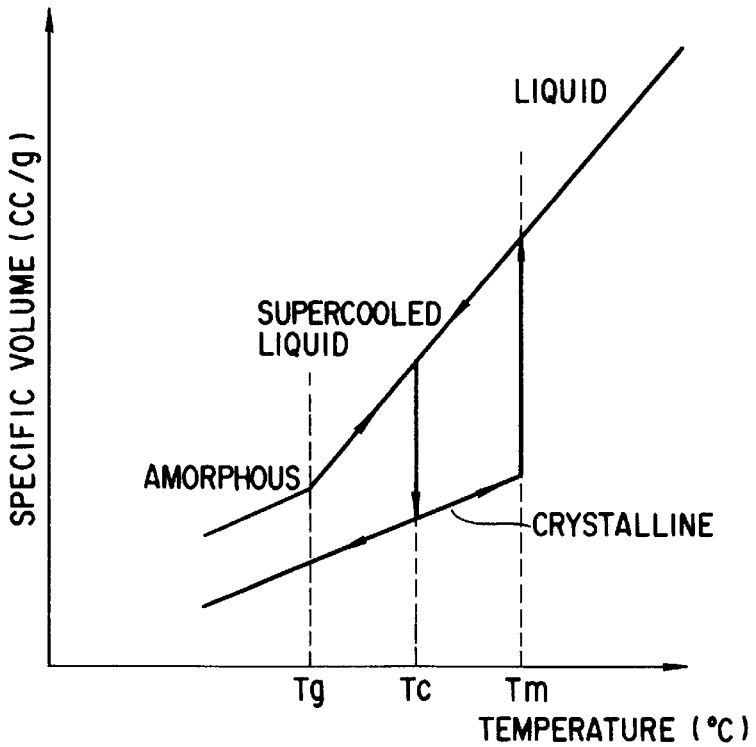
FIG. 2 shows the heat properties of a reversible thermal recording material of the present invention, which is of a three-component system consisting of a color former, a developer and a reversible material.

FIG. 2 shows the thermal properties of the three component system in respect of the recording-erasing of information based on the reversible transition of the system between the crystalline state and amorphous state. The system assumes a metastable amorphous state under room temperature. If the system is heated from the amorphous state to temperatures falling within the range between the crystallization temperature Tc and the melting point Tm, followed by cooling, the system assumes a stable crystalline state under temperatures not higher than the glass transition temperature Tg. Further, if the system is heated from the crystalline state to temperatures not lower than the melting point Tm so as to melt the system, followed by quenching or natural cooling to room temperature lower than the glass transition temperature Tc, the system is brought back to the amorphous state. It follows that a reversible transition between the crystalline state and the amorphous state can be achieved by supplying heat energies of two different values such that the composition system can be heated to temperatures between the crystallization temperature Tc and the melting point Tm and to the temperatures higher than the melting point Tm, as described previously.

The three component system of the present invention consisting of the color former, the developer and the reversible material generally performs the color development and decoloring functions as follows. Specifically, under the amorphous state, the color former and the developer are uniformly mixed within the reversible material, with the result that the interaction between the color former and the developer is decreased so as to achieve the decolored state. Under the crystalline state, however, the color former and the developer are segregated at the grain boundaries of the crystallized reversible material, leading to an increased interaction between the color former and the developer so as to achieve a color development.

In the present invention, the phase separation controller denotes a low molecular organic material having the properties given below:

1. The phase separation controller should have a melting point lower than the melting point of the composition consisting of the color former, the developer and the reversible material.

2. The phase separation controller should be substantially irrelevant to the color development achieved by the interaction between the color former and the developer in a solid state.

3. The phase separation controller should be capable of dissolving the developer (or the color former) at temperatures higher than the melting point thereof.

4. The diffusion speed of the developer (or the color former) at temperatures higher than the melting point of the phase separation controller should markedly differ from that at temperatures lower than the melting point of the phase separation controller. In other words, the phase separation controller should be capable of rapidly promoting the phase separation of the composition in the vicinity of the melting point thereof.

5. The interaction between the molten phase separation controller and the developer (or the color former) should be weaker than the interaction between the molten reversible material and the developer (or the color former).

6. The phase separation controller has at least one polar group which is the same that the reversible material has.

Figure 3:
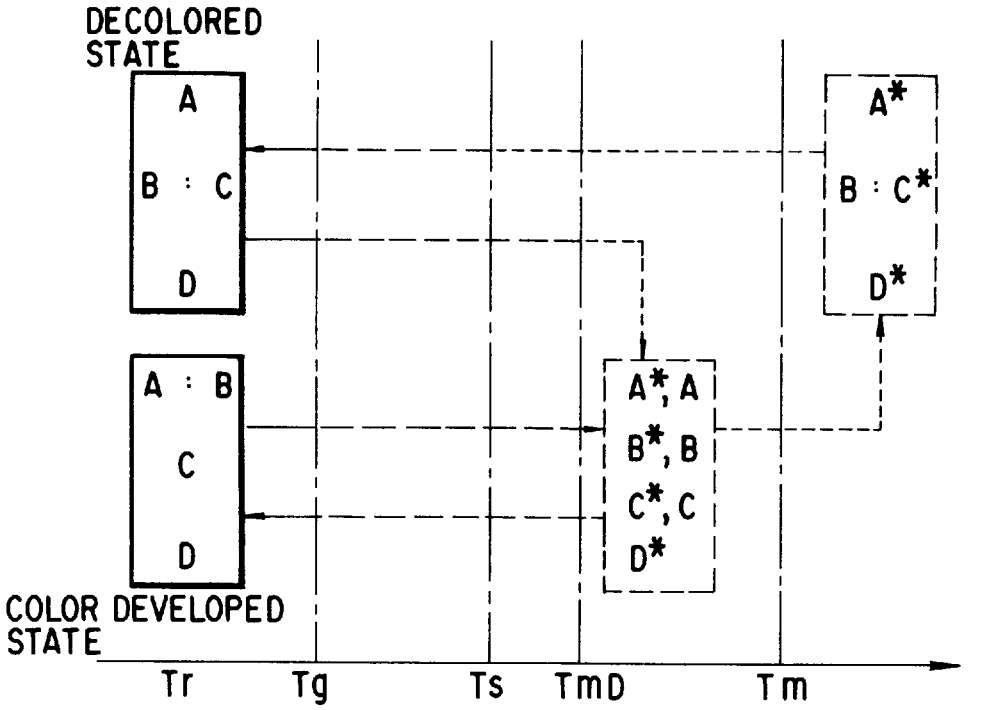
FIG. 3 shows the operating principle of a reversible thermal recording material of the present invention, which is of a four-component system consisting of a color former, a developer, a reversible material and a phase separation controller.

FIG. 3 exemplifies a typical color development-decoloring mechanism of the four component system of the present invention consisting of the color former A, the developer B, the reversible material C and the phase separation controller D. The symbols put in FIG. 3 are equal to those in FIG. 1, except that "TmD" in FIG. 3 represents the melting point of the phase separation controller D.

At room temperature Tr, the color developed state, in which a mixed phase of the color former A and the developer B is separated from the phase of the reversible material C and the phase of the phase separation controller D, is close to the state of equilibrium in terms of solubility. When the particular four component system is heated from this state to temperatures not lower than the melting point Tm of the system, the developer B and the reversible material C in a fluidized state are dissolved in each other. As a result, the interaction between the developer B and the color former A is lost, leading to decoloring. If cooled from the molten state, the system is put in a supercooled liquid in which the reversible material C and the phase separation controller D maintain fluidity even under temperatures lower than the melting point of the system. In this case, the four component system is solidified at temperatures lower than the glass transition point Tg, with the developer B and the reversible material C under a fluidized state dissolved in each other. As a result, the reversible material C takes into itself the developer B in excess of the equilibrium solubility so as to put the system in an amorphous and colorless nonequilibrium state. It follows that the four component system of the present invention is capable of arriving at the colorless nonequilibrium state by either the rapid cooling or gradual cooling unlike the three component system described previously. The four component system in the nonequilibrium amorphous state also exhibits a very long life under temperatures lower than the glass transition point Tg of the system. Where the glass transition point Tg is higher than room temperature, it is substantially impossible for the nonequilibrium state to be converted into the equilibrium state.

If the four component system of the nonequilibrium amorphous state is heated to temperatures higher than the glass transition point of the system, the diffusion speed of the developer B is rapidly increased, with the result that the phase separation between the developer B and the reversible material C is accelerated toward the state of equilibrium. If the system is further heated to temperatures higher than the melting point TmD of the phase separation controller D, the liquefied phase separation controller D dissolves the developer B and some portion of the reversible material C. As a result, the diffusion speed of the developer B is drastically increased so as to drastically accelerate the phase separation between the developer B and the reversible material C. If the system under this condition is cooled to temperatures lower than the solidifying point of the phase separation controller D, the solubility of the developer B in the phase separation controller D is rapidly lowered so as to achieve instantly the phase separation between the developer B and the phase separation controller D. As a result, the interaction takes place between the phase-separated developer B and the color former A so as to put the system in a color developed state which is closer to the state of equilibrium.

The color developing speed of the four component system containing the phase separation controller specified in the present invention under temperatures higher than the glass transition point of the system is $10^2$ to $10^4$ times as high as that under temperatures lower than the glass transition point. Further, the color developing speed in question under temperatures higher than the melting point of the phase separation controller contained in the system is $10^3$ to $10^4$ times as high as that under temperatures lower than the melting point. It follows that it is highly significant to supply appropriately heat energies of two different values, which permits heating the four component system to temperatures higher than the melting point Tm of the system and also permits heating the system to temperatures falling within the range between the melting point TmD of the phase separation controller contained in the system and the melting point Tm of the system. In this case, it is possible to reversibly repeat the phase change between the equilibrium state and the nonequilibrium state (or between the color developed state and the decolored state) at a very high speed, while markedly suppressing the effects given by the different heat histories of the rapid cooling and the gradual cooling.

The operating principle shown in FIG. 3 is no more than an example. Of course, various modifications are available in the present invention. For example, it is not absolutely necessary for the glass transition point Tg to be lower than the solidifying point Ts of the system. Also, it is not absolutely necessary for the entire amount of the reversible material to be melted under temperatures higher than the melting point Tm of the system. To be more specific, if the reversible material is melted in an amount sufficient for taking the developer into the melt, the system is put under the decolored state after the cooling of the system. Likewise, the entire amount of the developer need not be dissolved under temperatures higher than the melting point TmD of the phase separation controller. It suffices for the amount of dissolution to be about several percent, as far as the phase separation (i.e., diffusion of the developer or the color former) can be performed at a sufficiently high speed compared with under the solidified state.

Where the composition used in the reversible thermal recording medium of the present invention does not contain a reversible material, the phase separation controller contained in the resultant three component system consisting of the color former, the developer, and the phase separation controller performs the functions similar to those described above. It should be noted that the two component system consisting of the color former and the developer is capable of assuming the two states given below:

(1) The phase of the color former is separated from the phase of the developer so as to put the two component system in a decolored state (equilibrium state).

(2) The developer takes the color former into itself in a large amount exceeding an equilibrium solubility so as to bring about an interaction between the two and, thus, to develop a color (nonequilibrium state).

Each of the states (1) and (2) exhibits a long life. If a phase separation controller is added to the two component system consisting of the color former and the developer, the diffusion speed of the color former within the developer is increased so as to improve the decoloring speed of the resultant three component system.

As described above, heat energies having two different values are supplied appropriately to the reversible thermal recording medium of the present invention so as to reversibly repeat the change between two different states of phase separation. As a result, the degree of interaction between the color former and the developer is changed so as to record or erase information. The change in the states of the phase separation noted above can be explained as a phenomenon which is generally known to the art as a spinodal decomposition or microphase separation.

To determine whether the composition used in the present invention is crystalline or amorphous, it is possible to employ general methods such as an X-ray diffractometry, an electron beam diffractometry and measurement of a light transmittance. When it comes to, for example, the X-ray diffractometry or electron beam diffractometry, sharp peaks or spots can be observed in the case of a crystalline composition, though such peaks or spots cannot be observed in the case of an amorphous composition. On the other hand, a light scattering of the composition can be evaluated when it comes to the measurement of a light transmittance. It should also be noted that, where the composition is polycrystalline, the light is scattered more strongly with decrease in the wavelength of the light, leading to a low light transmittance. It follows that the decrease in the light transmittance caused by the light scattering can be distinguished from the decrease in the light transmittance caused by the light absorption by looking into the dependence of the light transmittance on the wavelength of light, making it possible to estimate the grain diameter of the crystal.

In the reversible thermal recording medium of the present invention, it is possible for the repetition of the transition between the crystalline and the amorphous states to take place in the entire portion or some portion of the composition in recording-erasing information. Also, it is possible for every component of the composition to form a crystal individually. Alternatively, a plurality of components may collectively form a crystal. The X-ray diffractometry or electron beam diffractometry can also be employed for determining whether the repetition of transition between the crystalline and the amorphous states takes place in the entire portion or some portion of the composition. Specifically, since the peak or spot observed in the X-ray diffractometry or electron beam diffractometry has a pattern inherent in the particular component of the composition, it is possible to specify the component which repeats the crystalline-to-amorphous transition within the composition by analyzing the pattern of the peak or spot.

In the present invention, a change in the states of the composition in the form of any of the transition between the crystalline and amorphous states and the change in the states of phase separation takes place when a heat energy is supplied to the composition. Which type of the change in the states of the composition to take place depends not only on the kinds and combination of the components of the composition but also on the mixing ratio of the components. Incidentally, the type of change in the states of the composition can be estimated on the basis of the change with time in the colored state of the composition which takes place when the composition in a metastable nonequilibrium state is heated to temperatures higher than the glass transition point Tg to cause the composition to be converted toward the equilibrium state. To be more specific, a change with time in the reflection density or light transmittance is measured first, followed by obtaining therefrom a change with time in the colored state of the composition. Where the color change follows the Arrhenius equation, a thermal activation type reversible transition between the crystalline and the amorphous states is considered to have taken place preferentially. Where the color change follows the Vogel-Fulcher equation, however, a change in the states of the phase separation is considered to have taken place preferentially. It should be noted in this connection that the reversible transition between the crystalline and the amorphous states and the change in the states of the phase separation may take place simultaneously in some cases, though any of the reversible transition and the change in the states of the phase separation takes place independently in other cases in the composition used in the reversible thermal recording medium of the present invention.

In the present invention, recording-erasing of information can be performed on the basis of the reversible transition between the crystalline and the amorphous states or the change in the states of the phase separation by giving two heat histories differing from each other in the cooling rate after the heating to temperatures higher than the melting point Tm in place of supplying heat energies of two different values to the composition. To be more specific, if the composition heated to temperatures higher than the melting point Tm is cooled rapidly to room temperature, the reversible thermal recording medium of the present invention is allowed to assume a metastable nonequilibrium state. If cooled gradually, however, the recording medium is allowed to assume a equilibrium state. It follows that the transition between the crystalline and the amorphous states or the change in the states of the phase separation can be repeated reversibly by suitably selecting any of the rapid cooling or gradual cooling in the cooling step so as to control as desired the intensity of the interaction between the color former and the developer. Further, a stress may be applied to the composition in place of supplying heat energies in the process of conversion from the metastable nonequilibrium state of the composition to the equilibrium state.

The color former used in the present invention includes electron-donating organic substances such as leucoauramines, diarylphthalides, polyarylcarbinols, acylauramines, arylauramines, Rhodadmine B lactams, indolines, spiropyrans, fluorans, cyanine dyes and Crystal Violet, and electron-accepting organic substances such as phenolphthaleins.

To be more specific, the electron-donating organic substances include, for example, Crystal Violet lactone (CVL), Malachite Green lactone, 2-anilino-6-(N-cyclohexyl-N-methylamino)-3-methylfluoran, 2-anilino-3-methyl-6-(N-methyl-N-propylamino) fluoran, 3-[4-(4-phenylaminophenyl) aminophenyl]-amino-6-methyl-7-chlorofluoran, 2-anilino-6-(N-methyl-N-isobutylamino)-3-methyl-fluoran, 2-anilino-6-(dibutylamino)-3-methylfluoran, 3-chloro-6-(cyclohexylamino) fluoran, 2-chloro-6-(diethylamino) fluoran, 7-(N,N-dibenzylamino)-3-(N,N-diethylamino) fluoran, 3,6-bis (diethylamino) fluoran-γ-(4'-nitro) anilinolactam, 3-diethylaminobenzo [a]-fluoran, 3-diethylamino-6-methyl-7-aminofluoran, 3-diethylamino-7-xylidinofluoran, 3-(4-diethylamino-2-ethoxyphenyl)-3-(1-ethyl-2-methylindole-3-yl)-4-azaphthalide, 3-(4-diethylaminophenyl)-3-(1-ethyl-2-methylindol-3-yl) phthalide, 3-diethylamino-7-chloroanilinofluoran, 3-diethylamino-7,8-benzofluoran, 3,3-bis (1-n-butyl-2-methylindol-3-yl) phthalide, 3,6-dimethylethoxyfluoran, 3-diethylamino-6-methoxy-7-aminofluoran, DEPM, ATP, ETAC, 2-(2-chloroanilino)-6-dibutylaminofluoran, Crystal Violet carbinol, Malachite Green carbinol, N-(2,3-dichlorophenyl) leucoauramine, N-benzoylauramine, Rhodamine B lactam, N-acetylauramine, N-phenylauramine, 2-(phenylimino ethanedilydene)-3,3-dimethylindoline, N-3,3-trimethylindolinobenzospiropyran, 8'-methoxy-N-3,3-trimethylindolinobenzospiropyran, 3-diethylamino-6-methyl-7-chlorofluoran, 3-diethylamino-7-methoxy-fluoran, 3-diethylamino-6-benzyloxyfluoran, 1,2-benzo-6-diethylaminofluoran, 3,6-di-p-toluidino-4,5-dimethylfluoran-phenylhydrazide-γ-lactam, and 3-amino-5-methylfluoran.

On the other hand, the electron-accepting organic substances used in the present invention include, for example, phenolphthalein, tetrabromophenolphthalein, phenolphthalein ethyl ester, and tetrabromophenolphthalein ethyl ester.

The color former compounds exemplified above can be used singly or in the form of a mixture of a plurality of different compounds. In the present invention, a color display can be obtained because the colored states in various colors can be attained by properly choosing the color formers. Of the above compounds, cyanine dyes and Crystal Violet sometimes lose a color when the interaction with the developer is increased, and develop a color when the interaction is decreased. Further, any type of colored state can be obtained as desired by using the color former in combination with a coloring agent.

Where an electron-donating organic substance is used as the color former, the developer used in the present invention includes acidic compounds such as phenols, phenoxide, carboxylates, benzophenones, sulfonic acids, sulfonates, phosphoric acids, phosphates, acidic phosphoric esters, acidic phosphoric ester metal salts, phosphorous acids and phosphites. On the other hand, where an electron-accepting organic substance is used as the color former, it is desirable to use a basic compound such as amines as the developer. These compounds can be used singly or in the form of a mixture consisting of a plurality of different compounds.

The reversible material used in the present invention should desirably be capable of easily forming an amorphous phase having a good colorlessness. The contrast ratio between the printed portion and the background can be increased, if the reversible material is colorless and transparent in the amorphous state. For meeting these requirements, the reversible material should desirably have a high molecular weight, should be small in enthalpy change of melting ΔH of the crystal per weight and, thus, should be low in its maximum crystal growth velocity MCV. If the crystal of the reversible material has a small enthalpy change of melting ΔH, the heat energy required for melting the crystal is decreased, leading to an energy saving. Under the circumstances, it is desirable to use as the reversible material a compound having a bulky molecular skeleton close to a spherical form such as the steroid skeleton. Specifically, a compound having a plurality of sites at which intermolecular hydrogen bonds can be formed has a substantially large molecular weight, even if the compound itself has a low molecular weight or the enthalpy change of melting ΔH of the crystal of the compound is large to some extent. It follows that the particular compound is capable of easily forming an amorphous phase and, thus, can be used as a reversible material in the present invention. The substituents capable of an intermolecular hydrogen bond formation include, for example, hydroxyl group, primary and secondary amino groups, primary and secondary amide bonds, urethane bond, hydrazone bond, hydrazine group, and carboxyl group. In other words, it is desirable to use as the reversible material a compound having plurality of substituents exemplified above. Particularly, it is desirable to use a sterol compound as the reversible material in the present invention. Specific sterol compounds which can be used in the present invention include, for example, cholesterol, stigmasterol, pregnenolone, methylandrostenediol, estradiol benzoate, epiandrostene, stenolone, β-citosterol, pregnenolone acetate and β-cholestanol.

On the other hand, it is undesirable to use as the reversible material a low molecular compound having a molecular weight of less than 100 because such a compound has a large enthalpy change of melting ΔH of the crystal and, thus, is unlikely to form an amorphous phase. It is also undesirable for the same reason to use a long-chained linear alkyl derivative or a planar aromatic compound even if the molecular weight of such a compound is 100 or more. Further, it is also undesirable to use a compound forming an intramolecular hydrogen bond as the reversible material, even if the compound has a plurality of sites at which hydrogen bonds can be formed.

In the present invention, it is desirable to use as a phase separation controller a low molecular organic material which is highly crystallizable, the organic material having a long-chained alkyl group (methylene chain) and a polar group such as OH, CO or COOH. In general, the organic materials meeting these requirements include, for example, linear higher monohydric alcohols, linear higher polyhydric alcohols, linear higher monovalent fatty acids, linear higher polyvalent fatty acids, esters thereof, ethers thereof, linear higher fatty acid amides and linear higher polyvalent fatty acid amides.

To be more specific, the organic materials which can be used in the present invention as the phase separation controller include, for example, linear monohydric higher alcohols such as 1-tetradecanol, 1-hexadecanol, 1-octadecanol, 1-eicosanol, 1-docosanol, 1-tetracosanol, 1-hexacosanol, and 1-octacosanol; linear polyhydric higher alcohols such as 1,8-octanediol, 1,10-decanediol, 1,12-dodecanediol, 1,12-octadecanediol, 1,2-dodecanediol, 1,2-tetradecanediol, and 1,2-hexadecanediol; linear monovalent higher fatty acids such as palmitic acid, stearic acid, 1-octadecanoic acid, behenic acid, 1-docosanoic acid, 1-tetracosanoic acid, 1-hexacosanoic acid, and 1-octacosanoic acid; linear polyvalent higher fatty acids such as sebacic acid, dodecanedioic acid, and tetradecanedioic acid; linear higher ketones such as 14-heptacosanone and stearone; linear higher fatty acid alcohol amides such as ethanolamide laurate, n-propanolamide laurate, isopropanolamide laurate, butanolamide laurate, hexanolamide laurate, octanolamide laurate, ethanolamide palmitate, n-propanolamide palmitate, isopropanolamide palmitate, butanolamide palmitate, hexanolamide palmitate, octanolamide palmitate, ethanolamide stearate, n-propannolamide stearate, isopropanolamide stearate, butanolamide stearate, hexanolamide stearate, octanolamide stearate, ethanolamide behenate, n-propanolamide behenate, isopropanolamide behenate, butanolamide behenate, hexanolamide behenate, and octanolamide behenate; and linear higher fatty acid diol diesters such as ethyleglycol dilaurate, propyleneglycol dilaurate, butyleneglycol dilaurate, catechol dilaurate, cyclohexanediol dilaurate, ethyleglycol dipalmitate, propyleneglycol dipalmitate, butyleneglycol dipalmitate, catechol dipalmitate, cyclohexanediol dipalmitate, ethyleglycol distearate, propyleneglycol distearate, butyleneglycol distearate, catechol distearate, cyclohexanediol distearate, ethyleglycol dibehenate, propyleneglycol dibehenate, butyleneglycol dibehenate, catechol dibehanate, and cyclohexanediol dibehenate. These compounds can be used singly or in the form of a mixture of different compounds. A mixture which can be used as the phase separation controller can be chosen from an ester-based wax, an alcohol-based wax and an urethane-based wax.

The reversible thermal recording medium which can be put to a practical use is required to exhibit an excellent thermal stability and a high color developing speed. It should be noted that, if the nonequilibrium amorphous phase state is unstable, a phase separation takes place if the recording medium is simply left to stand at room temperature or is heated only slightly so as to give rise to a problem in terms of the thermal stability. In the present invention, it is important to choose the developer, reversible material and phase separation controller in a manner to improve the thermal stability of the thermal recording medium.

For improving the thermal stability of the thermal recording material of the present invention, it is particularly desirable to use as the developer a benzophenone compound having a phenolic hydroxyl group. The particular benzophenone compound, which exhibits a high affinity for the reversible material, permits improving the thermal stability of the thermal recording medium. To be more specific, where recording-erasing of information is performed on the basis of a change in the states of phase separation, the developer is taken into the reversible material in a large amount exceeding the equilibrium solubility, with the result that the recording medium assumes a metastable nonequilibrium state. If the developer and the reversible material exhibit a high affinity, the diffusion coefficient of the developer in the metastable nonequilibrium state is very small, with the result that a phase separation between the developer and the reversible material hardly proceeds even if the ambient temperature is somewhat high. Where recording-erasing of information is based on the reversible transition between the crystalline and the amorphous states, the amorphous phase, which is in a metastable nonueqilibrium state, can be formed with a high stability because there is a high potential barrier between the crystalline and the amorphous states. It follows that the metastable nonequilibrium state exhibits a sufficiently long life even if the ambient temperature is high, making it possible to obtain a reversible thermal recording medium excellent in its thermal stability. Further, the benzophenone compound, which is generally capable of absorbing an ultraviolet light, permits improving the resistance to light of the reversible thermal recording medium, leading to a further improved thermal stability.

The benzophenone compound used in the present invention as a developer is not particularly limited as far as at least one hydroxyl group is attached to the benzene ring included in the benzophenone skeleton. However, it is desirable for at least two hydroxyl groups to be attached to the benzene ring in order to ensure a sufficient affinity for the color former. In this case, it is desirable for each of $R^1$ and $R^2$ included in general formula (2) to have at least one hydroxyl group. It is more desirable for three hydroxyl groups to be attached to one of the two benzene rings included in the benzophenone skeleton. Particularly, it is most desirable for the three hydroxyl groups to be substituted in the 2-, 3-, 4- or 3-, 4-, 5-positions of the benzene ring. Specific benzophenone compounds used in the present invention are exemplified in Table 1. Needless to say, the benzophenone compound can be identified by specifying $R^1$ and $R^2$ included in the general formula (2), as shown in Table 1.

TABLE 1

| No. | $(R^1)m$ | $(R^2)n$ |
|---|---|---|
| 1 | 4-hydroxy | 4-hydroxy |
| 2 | 2,3,4-trihydroxy | — |
| 3 | 2,4-dihydroxy | 4-hydroxy |
| 4 | 2,4-dihydroxy | 2,4-dihydroxy |
| 5 | 2,3,4-trihydroxy | 4-hydroxy |
| 6 | 3,4-dihydroxy | 4-hydroxy |
| 7 | 3,4,5-trihydroxy | — |
| 8 | 2,4,5-trihydroxy | 4-hydroxy |
| 9 | 2,4,6-trihydroxy | 4-hydroxy |
| 10 | 3,4,5-trihydroxy | 4-hydroxy |
| 11 | 2,4-dihydroxy | 3,4-dihydroxy |
| 12 | 2,3,4-trihydroxy | 2,4-dihydorxy |
| 13 | 3,4,5-trihydroxy | 2,4-dihydorxy |
| 14 | 2,3,4-trihydroxy | 2,3,4-trihydroxy |
| 15 | 3,4,5-trihydroxy | 2,3,4-trihydroxy |
| 16 | 3,4,5-trihydroxy | 3,4,5-trihydroxy |
| 17 | 4-methyl | 2,3,4-trihydroxy |
| 18 | 2-methyl-4-hydroxy | 4-hydroxy |
| 19 | 2-methyl-3, 4-dihydroxy | 4-hydroxy |
| 20 | 2-methyl-4-hydroxy | 2,4-dihydroxy |
| 21 | 3,5-dimethyl-4-hydroxy | 2,3,4-trihydroxy |
| 22 | 4-ethyl | 2,4-dihydroxy |
| 23 | 4-ethyl | 2,3,4-trihydroxy |
| 24 | 2-ethyl-3, 4-dihydroxy | 4-hydroxy |
| 25 | 2-ethyl-4-hydroxy | 2,4-dihydroxy |
| 26 | 2-ethyl-4-hydorxy | 2,3,4-trihydroxy |
| 27 | 4-methoxy | 2,3,4-trihydroxy |
| 28 | 2-methoxy-4-hydroxy | 4-hydroxy |
| 29 | 2-methoxy-4-hydroxy | 2,4-dihydroxy |
| 30 | 2-methoxy-4-hydroxy | 2,3,4-trihydroxy |
| 31 | 4-propenyl | 2,4-dihydroxy |
| 32 | 2-propenyl-4-hydroxy | 2,4-dihydroxy |
| 33 | 2-propenyl-4-hydroxy | 2,3,4-trihydroxy |

It is also important to choose appropriately the reversible material in order to improve the thermal stability of the reversible thermal recording medium of the present invention. As apparent from the previous description of FIGS. 1 and 3, the thermal stability of the images in the reversible thermal recording medium of the present invention depends on the glass transition point Tg of the entire composition and on the diffusion speed of the developer (or the color former). Naturally, it may be reasonable to understand that a developer (or a color former) having a low diffusion speed may be effective for improving the thermal stability. However, a developer having a low diffusion speed leads to a marked decrease in the color developing speed and, thus, fails to provide an effective means for improving the thermal stability.

In view of the thermal stability of the reversible thermal recording medium, the reversible material should desirably have a glass transition point not lower than room temperature (25° C.), more desirably at least 50° C. of the glass transition point. Also, the crystallization temperature of the reversible material, which is affected by the heating rate, should fall within the range between the glass transition point and the melting point. On the other hand, for performing the recording-erasing at a high speed, the glass transition point of the reversible material should desirably be 150° C. or lower.

As a result of an extensive research made in an attempt to find a reversible material having a high glass transition point, the present inventors have found that it is desirable to use as the reversible material a sterol compound having particular molecular structures specified herein. Specifically, the sterol compound used in the present invention has a steroid skeleton represented by the structural formula (1) given previously. Also, each of the carbon-to-carbon bond between 2- and 3-positions and the carbon-to-carbon bond between 3- and 4-positions of the steroid skeleton should be a single bond. Further, a hydroxyl group should be attached to the carbon atom in at least the 3-position of the steroid skeleton. Still further, at least one of chemical structures (A) to (D) given previously should be bonded at 16- and 17-positions of the steroid skeleton.

The specific sterol compounds having the particular requirements include, for example, rockogenin, tigogenin, esmiragenin, hecogenin and diosgenin, where the compound has chemical structure (A), 17-acetoxy pregnenolone where the compound has chemical structure (B), 21-acetoxy pregnenolone where the compound has chemical structure (C), and 16-dehydro pregnenolone where the compound has chemical structure (D). Methylandrostenediol was considered in the past to be as the most effective reversible material in terms of the thermal stability of the recording medium under high ambient temperatures. In the case of using methylandrostenediol, the recording medium was capable of retaining the recorded images for about one hour under an ambient temperature of 90° C. However, the present inventors have found that, in the case of using the sterol compound exemplified above as the reversible material, the recording medium permits retaining the recorded images for one hour under an ambient temperature of 100° C. In the present invention, it is necessary for the reversible material to contain at least 80% by weight of the sterol compound.

Sterol compounds other than those defined above can also be used as a reversible material which permits improving the thermal stability of the reversible thermal recording medium of the present invention, though the effect produced by these sterol compounds is somewhat inferior to that produced by the sterol compounds defined above. To be more specific, a sterol compound having a —$OCOCH_3$ group attached to the carbon atom at 3-position of the steroid skeleton in addition to the structures defined previously can also be used as a reversible material in the present invention. The specific compounds meeting these requirements include, for example, 17-hydroxy-pregnenolone 3-acetate, 17-hydroxypregnenolone diacetate, and 5-pregnen-3β,17-diol-20-one 3-acetate.

It may be reasonable to understand that a steroid compound having a carboxyl group such as cholic acid can be used as a reversible material having a high glass transition point. It has been found, however, that, in the case of using a steroid compound having a carboxyl group, the color developing density of the entire composition is markedly lowered, though the glass transition point of the composition is certainly increased. Where, for example, the reversible material is prepared by adding 20% by weight of cholic acid to methylandrostenediol, the color developing density of the composition is lowered to half the value obtained in the case of using methylandrostenediol alone as the reversible material. Such being the situation, the amount of the steroid compound having a carboxyl group, when used, should desirably be at most 10% by weight based on the total amount of the reversible material.

It is also important to select appropriately the phase separation controller in order not to lower the thermal stability of the reversible thermal recording medium of the present invention. The phase separation controller used in the present invention has a long-chained alkyl group and a polar group, as already described. What is also important is that the phase separation controller should be a low molecular organic material having a minimum carbon chain length of at least 10 and should be highly crystallizable. Where the minimum carbon chain length is less than 10, the change from the nonequilibrium state to the equilibrium state is likely to take place easily. This is not desirable in terms of the thermal stability of the recording medium.

In counting the number of carbon atoms included in the carbon chain length noted above, the carbon atom bonded to the polar atom such as the oxygen atom or nitrogen atom should be regarded as a terminal of the longest carbon chain. For example, the carbon chain length should be interpreted to be 18 with respect to stearyl alcohol ($C_{18}H_{37}OH$), stearic acid ($C_{17}H_{35}COOH$), and stearone ($C_{17}H_{35}COC_{17}H_{35}$), and ethyleneglycol distearate ($C_{17}H_{35}COOC_2H_4OCC_{17}H_{35}$). The carbon chain length should be interpreted to be 12 with respect to 1,12-dodecanediol ($HOC_{12}H_{24}OH$), 1,12-octadecanediol ($HOC_{12}H_{24}(OH)C_6H_{13}$), lauric acid ($C_{11}H_{23}COOH$), dodecanedioic acid ($HOOCC_{10}H_{20}COOH$), and isopropanolamide laurate ($C_{11}H_{23}CONHCH_2CH(OH)CH_3$).

In order to ensure a thermal stability under about room temperature, the carbon chain length should be at least 10. For ensuring the thermal stability under temperatures of 40° C. or higher, the maximum carbon chain length in the phase separation controller should be at least 20.

The phase separation controller should desirably meet additional requirements given below:

(a) For obtaining images having a high color developing density, the total number of carbon atoms contained in the phase separation controller should be at most 36, preferably at most 32. It should be noted that the solubility of the developer (or color former) in the phase separation controller at temperatures around the melting point of the phase separation controller is gradually decreased with increase in the total number of carbon atoms, i.e., with increase in the size of the molecule. Incidentally, the color developing density is also affected by the kind of the polar group (presence or absence of a carbonyl group or carboxyl group) contained in the phase separation controller.

(b) For preventing the color developing density from being lowered markedly, the phase separation controller should desirably have a melting point of at most 140° C., preferably 70° to 120° C. If the melting point is unduly high, the interaction between the color former and the developer caused by, for example, a hydrogen bond is thermally weakened so as to decrease the number of molecular pairs between the two, said molecular pair assuming a color developing state. Also, the solubility of the reversible material in the phase separation controller is sharply increased on the side of high temperatures, compared with the solubility of the developer (or color former) in the phase separation controller. Of course, the acceptable upper limit of the melting point of the phase separation controller is fluctuated to some extent depending on the maximum carbon chain length, the kind of the polar group of the phase separation controller, and the kind of the developer (or color former) contained in the composition.

(c) For improving the color developing-decoloring speed, the molecular weight of the phase separation controller should desirably be at most 1000. The phase separation controller having a molecular weight exceeding 1000 has an unduly high viscosity, when liquefied. Therefore, a sufficiently high diffusion rate of the developer cannot be obtained as well as the solubility of the developer in the phase separation controller is lowered.

(d) It is preferable that the phase separation controller has at least one hydroxyl group in a molecule.

The phase separation controller meeting these requirements (a) to (d) include, for example, aliphatic monohydric or polyhydric alcohols having 20 to 36 of the maximum carbon chain length.

For enabling the reversible thermal recording medium of the present invention to exhibit an improved color developing speed while retaining a high thermal stability, it is important to pay attentions to the combination of the reversible material and the phase separation controller which are used together. The present inventors have conducted an experiment in which an aliphatic monohydric alcohol was used as a phase separation controller in a composition of four component system consisting of a color former, a developer, a reversible material and a phase separation controller. It has been found that a color development using a hot stamper can be achieved in a stamping time of 0.1 to 0.2 second. However, no further improvement in the color developing speed can be obtained, resulting failure to arrive at such a high color developing speed as several milliseconds (ms), as in the use of a TPH.

From the results of further experiments, the present inventors have found that the color developing process involved in the reversible thermal recording medium of the present invention includes a first step in which the structure of the composition in a non-equilibrium amorphous state is changed, and a second step in which the main component are diffused. The structural change in the first step includes change in molecular structure of the components and change in three-dimensional arrangement of the components in the composition in an amorphous state. Therefore, it has also been found that it is important to accelerate the structural change in the first step to improve color developing speed. That is, the phase separation controller should be a material that not only permits increasing the diffusion rate of the developer but also serves to activate the first step involving the structural change. Further, an aliphatic polyhydric alcohol having hydroxyl groups attached to the carbon atoms at the ends of the carbon chain, particularly a linear diol having at least 10 of the maximum carbon chain length, has been found to provide a phase separation controller effective for achieving a high color developing speed. In this case, it is assumed that the linear diols as the phase separation controller represent a function to activate the structural change in the composition in the amorphous state because they can represent structural similarity to sterol compounds as the reversible material. Incidentally, where the linear diol has at least 10 of the maximum carbon chain length, the thermal stability of the recording medium can be improved, as already described.

It is most desirable to use the sterol compound, particularly a sterol compound having a —$OCOCH_3$ group attached to the carbon atom at the 3-position of the steroid skeleton, as a reversible material in combination with the linear diol noted above. It is also desirable to use a sterol compound having a spirostan structure (a sterol compound having structural formula (A) given previously at 16- and 17-positions of the steroid skeleton). The sterol compounds of the former type include, for example, 5-pregnene-3β-diol-20-one 3-acetate. Also, the sterol compounds of the latter type include, for example, rockogenin, tigogenin, esmiragenin, hecogenin and diosgenin.

As apparent from the description given above, the composition most desirable in terms of the thermal stability and color developing speed of the reversible thermal recording medium of the present invention contains a color former, a benzophenone compound having a phenolic hydroxyl group, which is used as a developer, a sterol compound having a —$OCOCH_3$ group attached to the carbon atom at 3-position of the steroid skeleton, which is used as a reversible material, and a linear diol having at least 10 of the maximum carbon chain length, which is used as a phase separation controller. It should be noted in this connection that a composition of three component system consisting of a color former, a developer, and a reversible material, a composition of another three component system consisting of a color former, a developer, and a phase separation controller, or a composition of four component system consisting of a color former, a developer, a reversible material, and a phase separation controller can be used for manufacturing a reversible thermal recording medium of the present invention, as already described. What is important is that, if any one of the color former, the developer and the phase separation controller contained in the composition of any of these three component systems and the four component system is formed of a material selected from the particularly desirable materials described above, the general materials described previously can be used as the other components of the composition. In this case, the resultant reversible thermal recording medium is enabled to be superior to the conventional thermal recording medium in any of the thermal stability and the color developing speed.

In the reversible thermal recording medium of the present invention, a phase separation controller capable of supercooling can be effectively used for improving the color developing speed. Attentions should be paid in this connection to the mechanism of the color development achieved in the reversible thermal recording medium of the present invention. Specifically, for achieving the color development, the developer (or color former) is required to be diffused by a predetermined distance within the composition so as to lead to association between the color former and the developer. The diffusion distance L of the developer (or the color former) within the composition is represented by: $L=D^{1/2}.t$, where D means a diffusion coefficient, and t denotes time. In the composition of the four component system containing a phase separation controller, the diffusion coefficient D of the developer (or the color former) under a predetermined writing temperature is higher than that in the composition of the three component system. As a result, a sufficiently long diffusion distance can be ensured even if the diffusion time t is short, leading to an improved thermal writing speed. For example, the color developing speed in the four component system is 10 to 100 times as high as that in the three component system. This denotes that the diffusion coefficient D in the four component system is 100 to 10,000 times as large as that in the three component system. This implies that an additional marked improvement in the diffusion coefficient D may not be achieved by simply selecting an optimum phase separation controller. Naturally, it is necessary to increase the diffusion time t for further improving the color developing speed. Further, the heat supply time does not necessarily correspond to the diffusion time. It has been found that the effective heating time t can be increased, if the fluidized state of the phase separation controller can be maintained for a long time during the heat supply to the recording medium.

The fluidized state of the phase separation controller can be maintained for a long time, if a difference between the melting point and the solidifying point of the phase separation controller is increased to enable the phase separation controller to exhibit a supercooling property. What should be noted is that the color developing speed can be further improved, if the substantial diffusion time of the developer (or color former) within the recording medium is made longer by elongating the period of time during which the fluidized state of the phase separation controller is maintained. In the present invention, the phase separation controller is defined to exhibit a supercooling property in the case where a difference between the melting point and the solidifying point is at least 10° C. in the DSC analysis measured at a temperature change rate of 10° C./min. Further, the difference between the melting point and the solidifying point of the phase separation controller should desirably be at least 20° C. in order to sufficiently elongate the period of time during which the fluidized state of the phase separation controller is maintained.

A phase separation controller in the form of a mixture consisting of a plurality of different organic compounds is likely to exhibit the supercooling property more easily. Particularly, it is desirable for the component compounds to be different from each other in the melting point by at least 8° C., preferably by at least 15° C. In this case, it is desirable to use as at least one component of the mixture.linear higher alcohols having at least 20 of the maximum carbon chain length, at most 36 carbon atoms in total, a melting point of 70° C. to 120° C., and at least one hydroxyl group. The other organic compound which is used together with the particular linear higher alcohols includes, for example, other linear higher alcohols, linear higher polyhydric alcohols, linear higher fatty acids, linear higher polyvalent fatty acids, esters thereof, ethers thereof, linear higher fatty acid amides and linear higher polyvalent fatty acid amides. The plural organic compounds which are used together in the form of a mixture should be different from each other in the carbon chain length, in the substituting position of the polar group, or in the kind of the polar group included in the organic compound. For preparing a mixture of organic compounds differing from each other in the kind of the polar group, it is desirable to use, for example, a compound having a hydroxyl group and another compound having a carboxyl group, an amide group or an amino group. Further, the phase separation controller used in the present invention should desirably be crystallizable.

Figure 4:
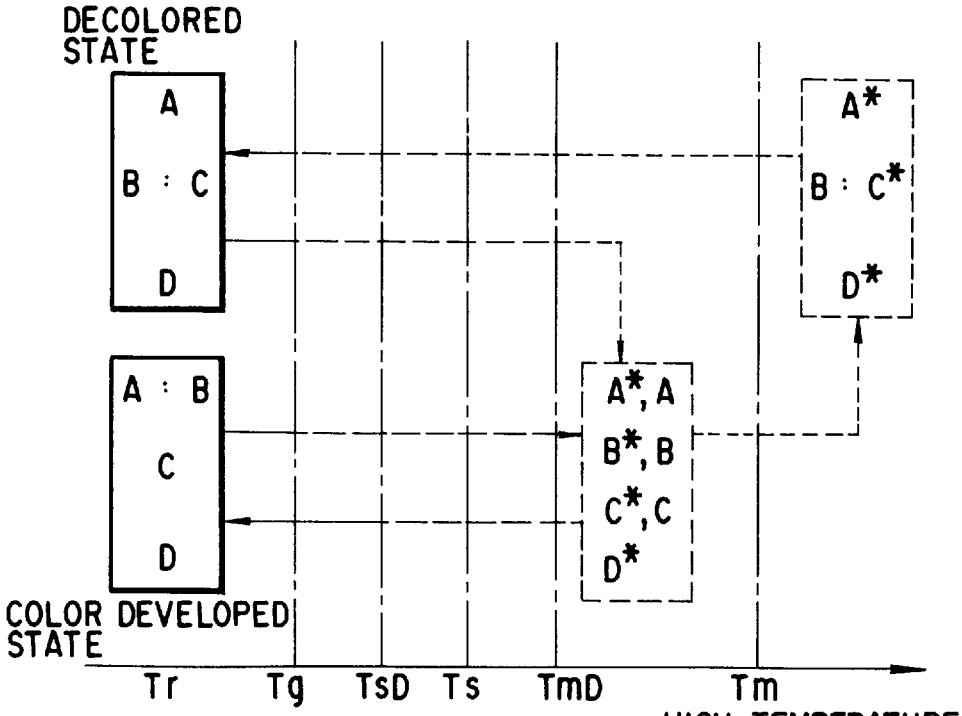
FIG. 4 shows the operating principle of a reversible thermal recording material of the present invention, which is of a four-component system consisting of a color former, a developer, a reversible material, and a mixed phase separation controller.

FIG. 4 exemplifies a typical color developing-decoloring mechanism of a four component system consisting of a color former, a developer, a reversible material, and a phase separation controller capable of supercooling. The symbols put in FIG. 4 are equal to those put in FIG. 3, except that "TmD" and "TsD" in FIG. 4 represent the melting point and solidifying point, respectively, of the phase separation controller.

At room temperature Tr, the color developed state, in which the phases of the color former A and the developer B are separated from the phase of the reversible material C and from the phase of the phase separation controller D, is in a state close to an equilibrium state in solubility. If the composition of this four component system is heated from this state to temperatures not lower than the melting point Tm, the developer B and the reversible material C in a fluidized state are dissolved in each other, resulting in loss of the interaction with the color former A. It follows that the composition of the four component system is decolored. If the four component system is cooled from the molten state, each of the reversible material C and the phase separation controller D is turned into a supercooled liquid which retains its fluidity even under temperatures lower than the melting point. In this case, the mutually dissolved system consisting of the developer B and the reversible material C in a fluidized state is solidified at temperatures lower than the glass transition point Tg. As a result, the reversible material C is allowed to take the developer B into itself in a large amount exceeding the equilibrium solubility so as to be converted into an amorphous and colorless nonequilibrium state. These processes are equal to those shown in FIG. 3.

If the four component system is heated from the nonequilibrium amorphous state to temperatures exceeding the glass transition point, the diffusion speed of the developer B is rapidly increased, with the result that the phase separation between the developer B and the reversible material C is accelerated toward the equilibrium state. If the four component system is further heated to temperatures exceeding the melting point TmD of the phase separation controller D, the liquefied phase separation controller D is dissolved in a portion of the developer B and in a portion of the reversible material C. As a result, the diffusion speed of the developer B is drastically increased so as to markedly promote the phase separation between the developer B and the reversible material C. It follows that an association of the developer B and the color former A is achieved in a short time. In this step, however, the developer B does not act on the color former A, with the result that the four component system assumes a decolored state or a semi-decolored state.

The particular state noted above is retained until the temperature of the four component system is lowered to temperatures lower than the solidifying point TsD of the phase separation controller D. Since the phase separation controller used in the present invention is capable of supercooling, the fluidized state is maintained even under temperatures lower than the melting point TmD. The diffusion speed of the developer B is also retained at a level substantially equal to that in a liquid phase. It should be noted that, if the solidifying point TsD of the phase separation controller D is sufficiently lower than the melting point TmD, the diffusion time within which the developer B (or color former A) is substantially diffused during the heat supplying time is made several times to scores of times as long as that in the case where the phase separation controller is incapable of supercooling. As a result, the association of the developer B and the color former A is further promoted. If the four component system is cooled to temperatures lower than the solidifying point TsD of the phase separation controller D, the solubility of the developer B in the phase separation controller D is rapidly lowered so as to achieve instantly the phase separation between the developer B and the phase separation controller D. As a result, an interaction takes place between the phase-separated developer B and the color former A so as to put the four component system in a more stable color developed state closer to the equilibrium state.

As described above, the phase separation controller capable of supercooling makes it possible to extend the substantial diffusion time of the developer (or color former) within the four component system, leading to an improvement in the color developing speed, compared with the case of using a phase separation controller which is incapable of supercooling. It follows that it is possible to shorten the stamping time in the case of using a hot stamper for the color development or a line period in the case of using a TPH for the color development.

Let us describe preferred mixing ratio of the color former, the developer, the reversible material, and the phase separation controller in the reversible thermal recording medium of the present invention.

Concerning the mixing ratio between the color former and the developer, it is desirable to use 0.1 to 10 parts by weight, preferably 1 to 2 parts by weight, of the developer relative to 1 part by weight of the color former. If the mixing amount of the developer is smaller than 0.1 part by weight, it is difficult to increase sufficiently the interaction between the color former and the developer in the recording or erasing time. On the other hand, if the mixing amount of the developer exceeds 10 parts by weight, it is difficult to decrease sufficiently the interaction between the developer and the color former in the recording or erasing time. In any of these cases, a display with an excellent contrast ratio is unlikely to be achieved.

It is desirable to use the reversible material in an amount of 1 to 200 parts by weight, preferably 3 to 30 parts by weight, relative to 1 part by weight of the developer. If the amount of the reversible material is smaller than 1 part by weight, the reversible material fails to dissolve sufficiently the developer, leading to a high residual color density in the decoloring step. If the amount of the reversible material exceeds 200 parts by weight, however, the color density in the color developing step is lowered.

Further, it is desirable to use the phase separation controller in an amount of 1 to 50 parts by weight, preferably 5 to 20 parts by weight in terms of the thermal stability of the recording medium, relative to 1 part by weight of the developer. If the amount of the phase separation controller is smaller than 1 part by weight, a marked improvement cannot be recognized in the color developing speed. If the amount exceeds 50 parts by weight, however, the glass transition point of the composition is rendered unduly low, giving rise to a problem in the thermal stability of the recording medium under ambient temperatures.

It should be noted that the mixing ratio of the reversible material to the developer, which should be set in the present invention, should be at least 15%, preferably at least 100%, larger than the ratio of the reversible material to the developer in a stable composition formed of the color former, the developer and the reversible material.

Figure 5:
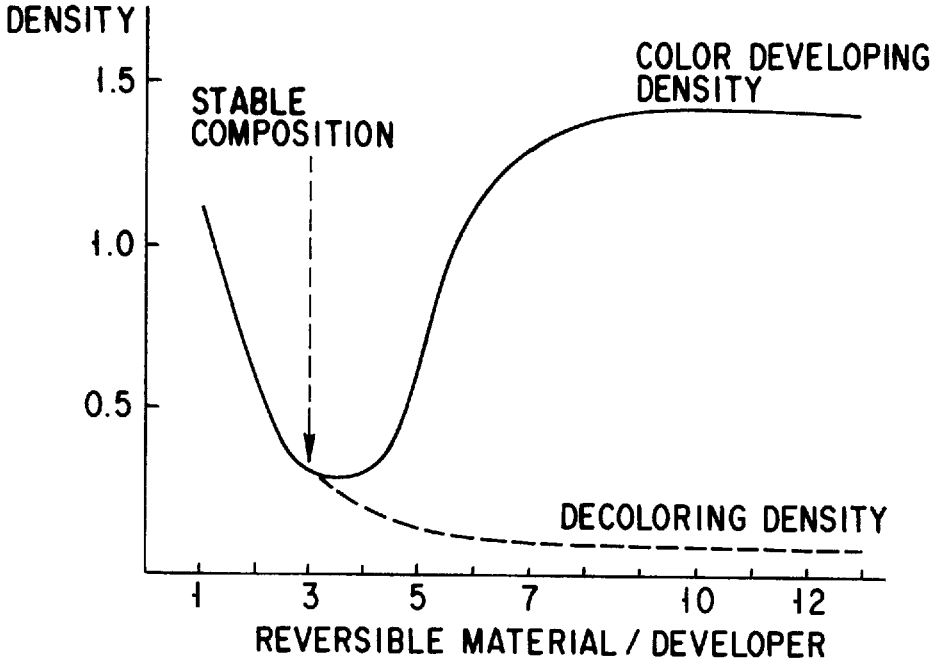
FIG. 5 is a graph used for describing what a stable composition is.

Let us describe a stable composition formed of CVL as a color former, propyl gallate as a developer, and pregnenolone as a reversible material with reference to a graph shown in FIG. 5. In preparing the data shown in FIG. 5, the color former and the developer were used in the same weight, with the mixing ratio of the reversible material to the developer changed variously over a range of 1 to 12. Under this condition, the reflection densities in the color developing step and in the decoloring step were measured so as to obtain the data given in the graph. As seen from FIG. 5, where the mixing ratio of the reversible material to the developer is 3 or less, the two states of the color developed state and the decolored state cease to be present at room temperature whether the composition is cooled rapidly or gradually. In this case, only one state, i.e., a thin color developed state, is present in the composition. The composition under such a thin color-developed state is defined herein as a stable composition. In other words, in the particular three component system, the stable composition is that the mixing ratio of the reversible material to the developer is 3 (or the weight of the reversible material is 3 times as high as that of the developer). The mixing ratio in the stable composition is dependent on the kind of the reversible material used. Also, the function performed by the reversible material is increased with decrease in the mixing ratio of the reversible material in the stable composition.

In view of the presence of the stable composition, it is considered reasonable to understand that a deviation of the composition from the stable composition affects the color developing and decoloring performed by the reversible thermal recording medium of the present invention. It is now necessary to give a supplementary description in respect to the color developing-decoloring mechanism shown in FIG. 1.

Specifically, two states alone at room temperature, i.e., the color developed state (crystalline state) and the decolored state (amorphous state), are shown in FIG. 1. However, the most stable third state, under which an intermediate color developed state is exhibited, has been clarified to be actually present. The most stable state can be obtained by gradually cooling the molten composition to room temperature or by annealing the composition at temperatures higher than glass transition point for a very long time, i.e., about 100–1000 times as long as the time required for the color development. The particular state is considered to be in the form of the stable composition consisting of the three components and crystals of excessive reversible material. This state is more stable in terms of energy than the color-developed state. On the other hand, in a composition containing the reversible material in an amount smaller than that in the stable composition, only one state is formed in which the phase of the color former and the developer is separated from the phase of the stable composition so as to cause the only one color-developed state. Thus, the two states of the color developed state and the decolored state cease to be present. It should be noted that the deviation of mixing ratio of the reversible material from that in the stable composition is considered to cause the structural change so as to control the color developing speed of the reversible thermal recording medium.

Figure 6:
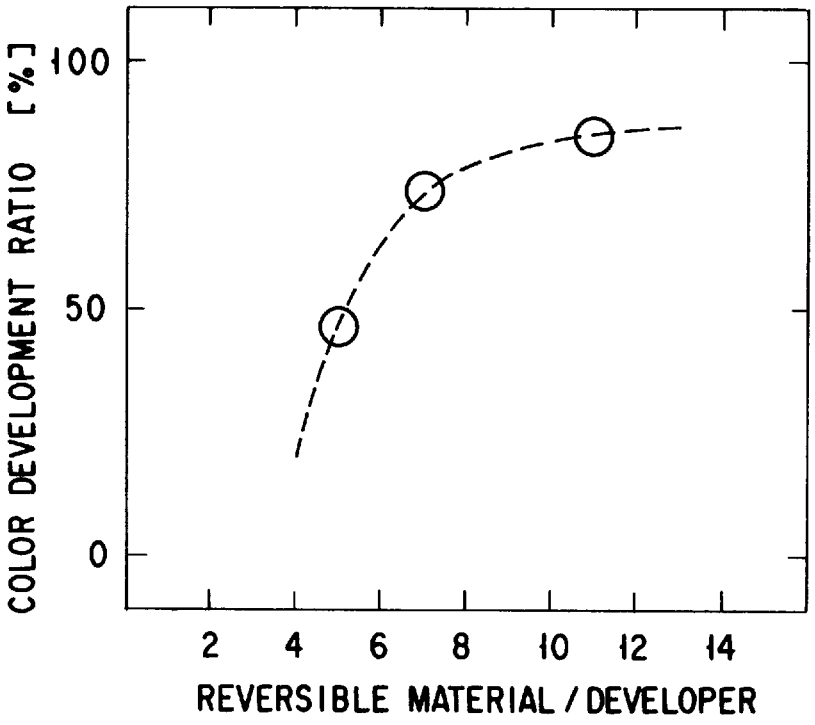
FIG. 6 is a graph showing the relationship between the color developing ratio and the mixing ratio of the reversible material to the developer.

Then, measurements of color development ratio with respect to various compositions having various mixing ratios of the reversible material to the developer were performed under the same condition using TPH. The results are depicted in FIG. 6. As shown in FIG. 6, the higher the mixing ratio of the reversible material, the higher the color development ratio becomes, i.e., the higher the color development sensitivity becomes. Since the reversible material in a fluidized state has a high viscosity, it is expected that the diffusion speed of the developer is lowered. Thus, it is expected that the higher the mixing ratio of the reversible material, the lower the color development sensitivity becomes. However, FIG. 6 represents the opposite result to the above expectation. Therefore, the working hypothesis that the deviation of mixing ratio of the reversible material from that in the stable composition controls the color developing speed of the reversible thermal recording medium is proved to be reasonable. Further, in order to increase the color developing speed, it is necessary to make the mixing ratio of the reversible material to the developer larger by at least 15%, preferably by at least 100%, than that in the stable composition. Here, the upper limit of the mixing ratio of the reversible material is determined based on the condition that sufficiently high color developing density is achieved, as already described.

In the reversible thermal recording medium of the present invention, it is possible to add, as required, a pigment, a fluorescent dye, an ultraviolet absorber, a heat insulating agent, a heat accumulating agent, etc. to the composition consisting of color former, the developer, the reversible material and the phase separation controller. If, for example, a pigment is selected appropriately in view of the color former contained in the composition, it is possible to obtain a desired colored state in each of the color-developed state and the decolored state.

In order to use the reversible thermal recording medium of the present invention in the form of a bulk, a composition of the particular components described previously is melted in a solventless condition for the mixing purpose, followed by solidifying the composition by a rapid cooling or a natural cooling. A recording medium of a desired shape can be obtained by shaping the molten composition by using a mold. It is also possible to obtain a recording medium in the form of a thin film by expanding the molten composition to form a thin layer. A recording medium in the form of a thin film can also be obtained by dissolving the composition in a suitable solvent, followed by casting the resultant solution. It is desirable for the thin film thus formed to have a thickness of 0.5 to 100 $\mu$m, preferably 1.5 to 20 $\mu$m. If the film is unduly thin, the resultant reversible thermal recording medium tends to fail to develop color in a sufficiently high density. If the film is unduly thick, however, a large heat energy is required in the recording-erasing step, making it difficult to perform the recording-erasing operation at a high speed. In addition, a temperature gradient is brought about across the film in a thickness direction by the heating applied to one surface of the film, resulting in failure to obtain a uniform color-developed state and a uniform decolored state. For performing the recording-erasing operation uniformly and at a high speed, the allowable maximum thickness of the film should be about 100 $\mu$m in the case of heating with a hot stamper and about 20 $\mu$m in the case of heating by means of laser heating.

Where a composition of the present invention consisting exclusively of the four components, i.e., a color former, a developer, a reversible material and a phase separation controller, is formed into a recording medium in the form of a thin film, defects are likely to be generated in the thin film, if heat is repeatedly applied to the thin film for operating the recording medium. To be more specific, since each of the four components of the composition consists of a low molecular compound, these compounds are recrystallized when the film is heated repeatedly, leading to the defect generation noted above. In this case, the thin film cannot be used as a recording medium. Therefore, in order to improve the mechanical strength of the reversible thermal recording medium of the present invention, it is possible to have the composition used in the present invention supported by a suitable medium. For example, the composition may be impregnated in a polymer sheet, may be dispersed in a binder polymer, may be dispersed in an inorganic glass, may be impregnated in a porous substrate, may be intercalated in a layered material, or may be encapsulated.

In order to allow a polymer sheet to be impregnated with the composition of the present invention, a polymer sheet having inner spaces large enough to hold the composition is impregnated with the composition melted in the absence of a solvent or a solution prepared by dissolving the composition in a suitable solvent. In view of the uniformity of the surface of the resultant reversible thermal recording medium, it is desirable to use a polymer having a high wettability with the molten composition or the solution. The specific polymers used in the present invention include, for example, polyether-ether ketones; polycarbonates; polyallylates; polysulfones; ethylene tetrafluoride resins; ethylene tetrafluoride copolymers such as an ethylene tetrafluoride-perfluoro alkoxyethylene copolymer, an ethylene tetrafluoride-perfluoroalkyl vinylether copolymer, ethylene tetrafluoride-propylene hexafluoride copolymer, and an ethylene tetrafluoride-ethylene copolymer; ethylene chloride trifluoride resins; vinylidene fluoride resins; fluorine-containing polybenzoxazoles;

polypropylenes; polyvinyl alcohols; polyvinylidene chlorides; polyesters such as polyethylene terephthalate, polybutylene terephthalate, and polyethylene naphthalate; polystyrenes; polyamides such as Nylon 66; polyimides; polyimidoamides; polyether sulfones; polymethylpentenes; polyetherimides; polyurethanes; polybudatienes; celluloses such as methyl cellulose, ethyl cellulose, cellulose acetate and nitrocellulose; gelatins; gum arabic; and papers such as neutral paper and acidic paper. It is particularly desirable to use celluloses and neutral paper because these media can be easily impregnated with the molten composition or the solution of the composition of the present invention. In addition, the resultant reversible thermal recording medium is enabled to exhibit a high density of the color development and a low residual color density under the decolored state.

For dispersing the composition of the present invention in a binder polymer, a molten composition or a solution of the composition of the present invention is dispersed together with the binder polymer and additional components, as required, by various dispersion methods. The resultant dispersion may be coated on a suitable substrate.

The binder polymers used in the present invention include, for example, polyethylenes; chlorinated polyethylenes; ethylene copolymers such as ethylene-vinylacetate copolymer, ethylene-acrylic acid-maleic anhydride copolymer; polybutadienes; polyesters such as polyethylene terephthalate, polybutylene terephthalate, and polyethylene naphthalate; polypropylenes; polyisobutylenes; polyvinyl chlorides; polyvinylidene chlorides; polyvinyl alcohols; polyvinyl acetals; polyvinyl butyrals; tetrafluoroethylene resins; trifluorochloroethylene resins; ethylene fluoride-propylene resins; vinylidene fluoride resins; vinyl fluoride resins; tetrafluoroethylene copolymers such as tetrafluoroethylene-perfluoroalkoxyethylene copolymer, tetrafluoroethylene-perfluoroalkyl vinyl ether copolymer, tetrafluoroethylene-hexafluoropropylene copolymer and tetrafluoroethylene-ethylene copolymer; fluoro resins such as fluorine-containing polybenzoxazol; acrylic resins; methacrylic resins such as polymethyl methacrylate; polyacrylonitriles; acrylonitrile copolymers such as acrylonitrile-butadiene-styrene copolymer; polystyrenes; halogenated polystyrenes; styrene copolymers such as styrene-methacrylic acid copolymer and styrene-acrylonitrile copolymer; acetal resins; polyamides such as Nylon 66; gelatin; gum arabic; polycarbonates; polyester carbonates; cullulose-based resins; phenolic resins; urea resins; epoxy resins; unsaturated polyester resins; alkyd resins; melamine resins; polyurethanes; diallyl phthalate resins; polyphenylene oxides; silicone resins; polyimides; bismaleimides; triazine resins; polyimidoamide resins; polyether sulfones; polymethyl pentenes; polyether ether ketones; polyether imides; polyvinyl carbazols; and thermoplastic resins such as norbornene-based amorphous polyolefins.

The dispersion methods used in the present invention include, for example, a mixer method, a sand mill method, a ball mill method, an impeller mill method, a colloid mill method, a three roll mill method, a kneader method, a two roll method, a Banbury mixer method, a homogenizer method and a nanomizer method. These dispersion methods can be selected appropriately in view of the viscosity of the molten composition or solution of the composition, as well as the use and type of the reversible thermal recording medium. Further, the coating methods for coating a substrate with the composition of the present invention include, for example, a spin coating method, a draw-up coating method, an air doctor coating method, a blade coating method, a rod coating method, a knife coating method, a squeeze coating method, an impregnation coating method, a reverse roll coating method, a transfer coating method, a gravure coating method, a kiss roll coating method, a cast coating method, a spray coating method, a curtain coating method, a calendar coating method, an extrusion coating method and an electrostatic coating method. These coating methods can also be selected appropriately in view of the use and type of the reversible thermal recording medium aimed at.

Where the composition forming a recording medium of the present invention is dispersed in a binder polymer, the binder polymer should be used in an amount of 0.01 to 100 parts by weight, preferably 0.05 to 20 parts by weight, relative to 1 part by weight of the reversible material. If the amount of the binder polymer is smaller than 0.01 part by weight, it is impossible to improve sufficiently the mechanical strength of the resultant recording medium. If the amount of the binder polymer exceeds 100 parts by weight, however, the color density in the color developing step of the recording medium tends to be lowered.

Where the composition forming the recording medium of the present invention is allowed to be supported by an inorganic glass, it is desirable to use an inorganic glass manufactured by a so-called sol-gel method. In this case, it is desirable for the gelling temperature not to be unduly high. Further, the porous substrates which can be used in the present invention include, for example, various inorganic compounds. On the other hand, the layered materials which can be used in the present invention include, for example, mica, clay mineral, talc and prase.

For preparing microcapsules having the composition of the present invention wrapped therein, it is possible to employ an interfacial polymerization method, an in-situ polymerization method, an in-liquid hardening covering method, a phase separation method from an aqueous solution system, a phase separation from an organic solution system, an in-gas suspension method, and a spray drying method. These methods can be properly chosen depending on the use and type of the reversible thermal recording medium aimed at. The materials used in the present invention for forming the shell of the microcapsule include, for example, condensed polymers such as melamine resins, epoxy resins, urea resins, phenolic resins, and furan resins; thermosetting resins such as styrene-divinyl benzene copolymer and methyl acrylate-vinyl acrylate copolymer, which are three-dimensionally crosslinked; and thermoplastic resins which have already been exemplified as binder polymers in which the composition of the present invention is dispersed. It is possible to form a shell of multi-layer structure by using a plurality of different resins selected from the thermosetting resins and the thermoplastic resins exemplified above. In this case, it is desirable to use a thermosetting resin for forming the outermost layer of the shell of the microcapsule in order to improve the thermal stability of the microcapsule. It is also possible to disperse the resultant microcapsules in the binder polymer or the inorganic glass exemplified above. It should be noted that, even if the composition itself is unlikely to be dispersed sufficiently in the supporting medium such as the inorganic glass, a satisfactory dispersion can be obtained in the case of dispersing the microcapsules in the supporting medium.

How to use the reversible thermal recording medium of the present invention is not particularly limited. For example, the recording medium can be used as a bulk, in combination with a supporting medium such as fibers, or in the form of a thin film formed on a suitable substrate. Of course, the thin film noted above acts as a recording layer. The substrate on which a thin film of the composition is formed in the present invention includes, for example, plastic films such as a polyethylene terephthalate film, a plastic plate, a metal plate, a semiconductor substrate, a glass plate, a wooden plate, a paper sheet, and an OHP sheet. It is also possible to coat the substrate with the microcapsules described previously, which are converted into a paint or an ink, followed by drying the paint or the ink, as required. In this case, different kinds of color formers can be wrapped in different microcapsules so as to achieve a desired color development easily. It is also possible to mix at a desired mixing ratio microcapsules containing different types of color formers, having different crystallization temperature Tc or different melting points Tm, and differing from each other in the state exhibited by the nonequilibrium state, i.e., whether the nonequilibrium state exhibits a color-developed state or decolored state. In this case, the colored state can be controlled in accordance with the magnitude of a supplied thermal energy. It follows that a full-color recording using color formers of, e.g., cyan, magenta and yellow can be achieved.

In the reversible thermal recording medium of the present invention, it is also possible to form a protective layer on the recording layer made of a thin film of the composition specified in the present invention for improving the durability of the recording layer or preventing the recording layer from being stuck to a thermal printer head (TPH) used for supplying a heat energy to the recording layer. The materials of the protective layer include, for example, a wax, a thermoplastic resin, a thermosetting resin, a photocurable resin, a water-soluble resin, and a latex. The thickness of the protective layer should desirably be 0.1 to 100 $\mu$m. Further, the protective layer may be allowed to contain additives such as a mold release agent, a lubricant, a heat-resistant material, and an antistatic agent. To be more specific, the recording layer may be coated with a dispersion or solution containing these additives together with the composition specified in the present invention, followed by drying the coating to form the particular protective layer. Alternatively, a heat resistant film having an adhesive coated thereon in advance may be bonded to the recording layer by a dry laminate method to form the protective layer in question. Further, it is desirable to form an undercoat layer between the substrate and the recording layer in order to improve the bonding strength between the substrate and the recording layer and to improve the solvent resistance of the recording medium.

The heat resistant films used in the present invention are not particularly limited as far as the film has a thermal deformation temperature higher than the melting point of the composition used as a recording material. For example, high molecular compounds can be used for forming these heat resistant films, including polyether-ether ketones; polycarbonates; polyallylates; polysulfones; tetrafluoroethylene resins; tetrafluoroethylene copolymers such as tetrafluoroethylene-perfluoroalkoxyethylene copolymer, tetrafluoroethylene-hexafluoropropylene copolymer, and tetrafluoroethylene-ethylene copolymer; trifluorochloroethylene resins; fluorinated vinylidene resins; fluorine-containing polybenzoxazoles; polypropylenes; polyvinyl alcohols; polyvinylidene chlorides; polyesters such as polyethylene terephthalate, polybutylene terephthalate, and polyethylene naphthalate; polystyrenes; polyamides such as Nylon 66; polyimides; polyimidoamides; polyethersulfones; polymethyl pentenes; polyether imides; polyurethanes; and polybutadienes. These high molecular materials can be selected appropriately in view of the use and type of the heat source and the resultant reversible thermal recording medium. Further, the adhesives generally used in the dry laminate method can be used in the present invention including, for example, acrylic resins; phenoxy resins; ionomer resins; ethylene copolymers such as ethylene-vinyl acetate copolymer, and ethylene-acrylic acid-maleic anhydride copolymer; polyvinyl ethers; polyvinyl formals; polyvinyl butyrals; gelatin; gum arabic; polyesters; polystyrenes; styrene copolymers such as styrene-acrylic acid copolymer; vinyl acetate resins; polyurethanes; xylene resins; epoxy resins; phenolic resins; and urea resins.

In order to perform the recording-erasing in the reversible thermal recording medium of the present invention on the basis of transition between the crystalline and the amorphous states or the change in the states of phase separation, heat energies having two different values are supplied to the recording medium, as already described. Alternatively, two kinds of heat histories differing from each other in the cooling rate after the heating of the recording medium to temperatures higher than the melting point Tm are applied to the recording medium, as already described.

It is desirable to use a TPH or a laser beam as a heat source for supplying heat energies to the recording medium in the recording step. The TPH, which is not amazingly high in resolution, permits heating the reversible thermal recording medium over a large area, and is advantageous in miniaturizing the apparatus. On the other hand, a laser beam easily permits a high density recording by diminishing the beam spot diameter, and also permits increasing the recording-erasing speed. In the case of using a laser beam, however, it is desirable to dispose a light absorbing layer having an absorption band in the wavelength of the laser beam or to allow the composition to contain a compound having an absorption band in the wavelength of the laser beam, in order to enable a highly transparent amorphous composition to absorb the laser beam efficiently.

Further, for supplying heat energies in the erasing step, it is desirable to use as a heat source a hot stamper or a heat roll which permits instantly heating the entire region of the reversible thermal recording medium. For the cooling of the recording medium once heated, the natural cooling can be employed. Also, it is desirable to employ rapid cooling by using a cold stamper, a cold roller, an air cooling using a cold air stream, or a Peltier element. Further, an overwriting can be achieved in the reversible thermal recording medium of the present invention by using a plurality of TPH's differing from each other in the energy value or a plurality of laser beams differing from each other in the diameter of the beam spot.

Let us describe Examples of the present invention.

EXAMPLE 1

1.0 part by weight of Crystal Violet lactone as a color former, 1.0 part by weight of 2,4,4'-trihydroxybenzophenone (Compound No. 3 shown in Table 1) as a developer, and 10.0 parts by weight of pregnenolone as a reversible material were blended and thermally melted to obtain a homogeneous composition. The resultant composition was found to exhibit a glass transition temperature Tg of 43.1° C., a crystallization temperature Tc of 71.6° C. and a melting point Tm of 182.1° C. The composition was disposed on a glass plate which was disposed on a hot plate so as to melt the composition. Another glass plate was disposed on the composition such that the composition was sandwiched and spread between the two glass plates. The resultant sample was used for a thermal stability test. Specifically, the sample was heated by the hot plate to temperatures exceeding 190°

C., followed by rapid cooling to room temperature, with the result that the sample was decolored to transparent. When heated again to 60° to 80° C. by the hot plate, the white decolored sample was colored blue. No change was recognized in the blue colored state when the sample was left to stand for cooling to room temperature.

The sample was also used for a test for measuring changes with time, which take place during the process of color development, in the transmittance of light having a wavelength of 610 nm. It was confirmed by the test that a change in the state of phase separation had taken place within the composition in the process of the color development.

The sample was heated again to 190° C., followed by rapid cooling to room temperature so as to bring the sample back to the white decolored state. Then, the sample was left to stand at 40° C., followed by measuring changes with time in the reflection density of light having a wavelength of 610 nm. The reflection density achieved by the sample was found to be about 4% five hours later, and about 17% fifty hours later relative to the saturated reflection density at the time of color development, which was set at 100%, supporting that the thermal stability of the sample under a decolored state was satisfactory.

On the other hand, another sample was prepared by impregnating a heat-resistant paper sheet with the composition described above. A contrast ratio of the color developing portion to the decolored port of the sample, which was determined on the basis of reflectance of light having a wavelength of 610 nm, was found to be as high as 26. Further, the contrast ratio was measured by repeating the color developing and decoloring operations, with the result that it was necessary to repeat the color developing-decoloring cycles more than 500 times in order to allow the contrast ratio to be lowered to half the original value.

An additional homogeneous solution was prepared by adding 12 parts by weight of the composition described above and 2 parts by weight of A91P (which is a trade name of styrene-methacrylic acid copolymer prepared by Dai-Nippon Ink K.K.) as a binder polymer to a cyclohexanone-toluene mixed solvent containing 10% by weight of cyclohexanone, followed by sufficiently mixing the resultant composition by using a ball mill. Then, a polyethylene terephthalate film 50 μm thick was coated with the resultant solution, followed by drying the solution to form a recording layer having a thickness of 10 μm. On the other hand, a protective film was prepared by coating one surface of a polyether-ether ketone film 3.5 μm thick with a silicone-based lubricating layer 0.1 μm thick and also coating the other surface with a styrene-methacrylic acid copolymer layer 0.1 μm thick. The resultant protective film was bonded to the recording layer by a dry laminate method such that the styrene-methacrylic acid copolymer layer was in direct contact with the recording layer so as to obtain a thermal recording medium of the present invention.

The entire surface of the thermal recording medium was allowed to exhibit a colored state of blue. When printing was applied under heat to the thermal recording medium by using a thermal head under a pulsed voltage of 15 to 17V with a pulse width of 5.2 msec, the printed portion alone was selectively decolored to exhibit a colorless, transparent state. In other words, the printing was satisfactory. Further, when the thermal recording medium was heated to about 130° C. by using a hot stamper or a heat roll, the printed portion was brought back to the blue colored state, indicating that the printing was erased. Incidentally, an additional thermal recording medium was prepared as above, except that the binder polymer of styrene-methacrylic acid copolymer was used in an amount of 4 parts by weight. The additional thermal recording medium was found to produce exactly the same results.

EXAMPLE 2

A thermal recording medium of the present invention was prepared exactly as in Example 1, except that polystyrene was used as a binder polymer in an amount of 4 parts by weight.

The entire surface of the thermal recording medium was allowed to exhibit a colored state of blue. When printing was applied under heat to the thermal recording medium by using a thermal head under a pulsed voltage of 15 to 17V with a pulse width of 5.2 msec, the printed portion alone of the recording layer was selectively decolored to exhibit a colorless, transparent state. Further, when the thermal recording medium was heated to about 130° C. by using a hot stamper or a heat roll, the printed portion was brought back to the blue colored state, indicating that the printing was erased.

EXAMPLE 3

A sample for testing a thermal stability was prepared exactly as in Example 1, except that 2,2',4,4'-tetrahydroxybenzophenone (Compound No. 4 shown in Table 1) was used as a developer in place of 2,4,4'-trihydroxybenzophenone used in Example 1. The resultant composition was found to exhibit a glass transition temperature Tg of 42.8° C., a crystallization temperature Tc of 70.3° C., and a melting point Tm of 180.3° C. Further, the resultant sample was found to exhibit color developing and decoloring behaviors similar to those exhibited by the sample of Example 1.

Then, the sample was left to stand at 40° C., followed by measuring changes with time in the reflection density of light, exactly as in Example 1. The reflection density achieved by the sample was found to be about 4% five hours later, and about 15% fifty hours later, supporting that the thermal stability under a decolored state was satisfactory. Further, it was found that the contrast ratio of the color generating portion to the decolored portion of the sample had been 26, and that the number of repetitions of the color developing and decoloring cycles required for decreasing the contrast ratio to half the original value had been more than 500.

EXAMPLE 4

A sample for testing a thermal stability was prepared exactly as in Example 1, except that 2,3,4,4'-tetrahydroxybenzophenone (Compound No. 5 shown in Table 1) was used as a developer in place of 2,4,4'-trihydroxybenzophenone used in Example 1. The resultant composition was found to exhibit a glass transition temperature Tg of 47.3° C., a crystallization temperature Tc of 74.7° C., and a melting point Tm of 185.3° C. Further, the resultant sample was found to exhibit color developing and decoloring behaviors similar to those exhibited by the sample of Example 1.

Then, the sample was left to stand at 40° C., followed by measuring changes with time in the reflection density of light, exactly as in Example 1. The reflection density achieved by the sample was found to be substantially 0% both 5 hours 50 hours later. Further, the reflection density of light was found to be about 11% five hours later, where the sample was left to stand at 60° C. These clearly support that the thermal stability under a decolored state was excellent. Further, it was found that the contrast ratio of the color developing portion to the decolored portion of the sample had been 24, and that the number of repetitions of the color developing and decoloring cycles required for decreasing the contrast ratio to half the original value had been more than 500.

EXAMPLE 5

A sample for testing a thermal stability was prepared exactly as in Example 1, except that 2,3,4-trihydroxybenzophenone (Compound No. 2 shown in Table 1) was used as a developer in place of 2,4,4'-trihydroxybenzophenone used in Example 1. The resultant sample was found to exhibit color developing and decoloring behaviors similar to those exhibited by the sample of Example 1.

Then, the sample was left to stand at 40° C., followed by measuring changes with time in the reflection density of light, exactly as in Example 1. The reflection density achieved by the sample was found to be substantially 0% five hours later, and about 8% fifty hours later, supporting that the thermal stability under a decolored state was satisfactory. Further, it was found that the contrast ratio of the color developing portion to the decolored portion of the sample had been 20, and that the number of repetitions of the color developing and decoloring cycles required for decreasing the contrast ratio to half the original value had been more than 500.

EXAMPLE 6

A sample for testing a thermal stability was prepared exactly as in Example 1, except that 4,4'-dihydroxybenzophenone (Compound No. 1 shown in Table 1) was used as a developer in place of 2,4,4'-trihydroxybenzophenone used in Example 1. The resultant composition was found to exhibit a glass transition temperature Tg of 43.0° C., a crystallization temperature Tc of 72.1° C., and a melting point Tm of 181.3° C. Further, the resultant sample was found to exhibit color developing and decoloring behaviors similar to those exhibited by the sample of Example 1.

Then, the sample was left to stand at 40° C., followed by measuring changes with time in the reflection density of light, exactly as in Example 1. The reflection density achieved by the sample was found to be about 9% five hours later, and about 17% fifty hours later, supporting that the thermal stability under a decolored state was satisfactory. Further, it was found that the contrast ratio of the color developing portion to the decolored portion of the sample had been 25, and that the number of repetitions of the color developing and decoloring cycles required for decreasing the contrast ratio to half the original value had been more than 500.

EXAMPLE 7

A sample for testing a thermal stability was prepared exactly as in Example 1, except that stigmasterol was used as a reversible material in place of pregnenolone used in Example 1. The resultant composition was found to color developing and decoloring behaviors similar to those exhibited by the sample of Example 1.

Then, the sample was left to stand at 40° C., followed by measuring changes with time in the reflection density of light, exactly as in Example 1. The reflection density achieved by the sample was found to be about 9% five hours later, and about 15% fifty hours later, supporting that the thermal stability under a decolored state was satisfactory. Further, it was found that the contrast ratio of the color developing portion to the decolored portion of the sample had been 29, and that the number of repetitions of the color developing and decoloring cycles required for decreasing the contrast ratio to half the original value had been more than 500.

EXAMPLE 8

A sample for testing a thermal stability was prepared exactly as in Example 1, except that 2,3,4,4'-tetrahydroxybenzophenone (Compound No. 5 shown in Table 1) was used as a developer in place of 2,4,4'-trihydroxybenzophenone used in Example 1. The resultant sample was found to exhibit color developing and decoloring behaviors similar to those exhibited by the sample of Example 1.

Then, the sample was left to stand at 40° C., followed by measuring changes with time in the reflection density of light, exactly as in Example 1. The reflection density achieved by the sample was found to be about 4% five hours later, and about 5% fifty hours later, supporting that the thermal stability under a decolored state was satisfactory. Further, it was found that the contrast ratio of the color developing portion to the decolored portion of the sample had been 24, and that the number of repetitions of the color developing and decoloring cycles required for decreasing the contrast ratio to half the original value had been more than 500.

EXAMPLE 9

A sample for testing a thermal stability was prepared exactly as in Example 1, except that 3,5-dimethyl-2,3,4,4'-tetrahydroxybenzophenone (Compound No. 21 shown in Table 1) was used as a developer in place of 2,4,4'-trihydroxybenzophenone used in Example 1. The resultant composition was found to exhibit color developing and decoloring behaviors similar to those exhibited by the sample of Example 1.

Then, the sample was left to stand at 40° C., followed by measuring changes with time in the reflection density of light, exactly as in Example 1. The reflection density achieved by the sample was found to be about 4% five hours later, and about 18% fifty hours later, supporting that the thermal stability under a decolored state was satisfactory. Further, it was found that the contrast ratio of the color developing portion to the decolored portion of the sample had been 24, and that the number of repetitions of the color developing and decoloring cycles required for decreasing the contrast ratio to half the original value had been more than 500.

Comparative Example 1

A sample for testing a thermal stability was prepared exactly as in Example 1, except that propyl gallate was used as a developer in place of 2,4,4'-trihydroxybenzophenone used in Example 1. The resultant composition was found to exhibit color developing and decoloring behaviors similar to those exhibited by the sample of Example 1.

The contrast ratio of the color developing portion to the decolored portion of the sample was found to be as high as 28. However, when the sample was left to stand at 40° C., followed by measuring changes with time in the reflection density of light, the reflection density achieved by the sample was found to be about 82% five hours later, and about 92% fifty hours later. Clearly, the sample was found to be poor in its thermal stability.

Comparative Example 2

A sample for testing a thermal stability was prepared exactly as in Example 1, except that bisphenol A was used as a developer in place of 2,4,4'-trihydroxybenzophenone used in Example 1. The resultant composition was found to exhibit color developing and decoloring behaviors similar to those exhibited by the sample of Example 1.

The contrast ratio of the color developing portion to the decolored portion of the sample was found to be as high as 18. However, when the sample was left to stand at 40° C., followed by measuring changes with time in the reflection density of light, the reflection density achieved by the sample was found to be about 85% five hours later, and about 95% fifty hours later. Clearly, the sample was found to be poor in its thermal stability.

EXAMPLE 10

1 part by weight of Crystal Violet lactone as a color former, 1 part by weight of propyl gallate as a developer and 10 parts by weight of various reversible materials shown in Table 2 were blended and, then, heated to melt the composition to obtain a homogeneous molten composition. Features in the molecular structure and the glass transition temperature of each of the reversible materials are shown in Table 2. As seen from Table 2, the glass transition temperatures of the reversible materials represented by the formulas (1), (A) and (B) are equal to or higher than the glass transition temperature of methylandrostenediol, which is also shown for the reference purpose.

TABLE 2

| Reversible material | Bond between 2- and 3-positions | Bond between 3- and 4-positions | Hydroxyl group at 3-position | Structure A | Structure B | Carboxyl group | Class transition point (°C.) |
|---|---|---|---|---|---|---|---|
| methyl and rostenediol | single bond | single bond | present | none | none | none | 62.5 |
| rockogenin | single bond | single bond | present | present | none | none | 91.9 |
| tigogenin | single bond | single bond | present | present | none | none | 67.6 |
| hecogenin | single bond | single bond | present | present | none | none | 80.2 |
| diosgenin | single bond | single bond | present | present | none | none | 69.0 |
| 17-acetoxy-pregnenolon | songle bond | single bond | present | none | present | present | 66.0 |

The composition was disposed on a glass plate which was disposed on a hot plate so as to melt the composition. Another glass plate was disposed on the composition such that the composition was sandwiched and spread between the two glass plates. The resultant sample was used for a thermal stability test.

Figure 7:
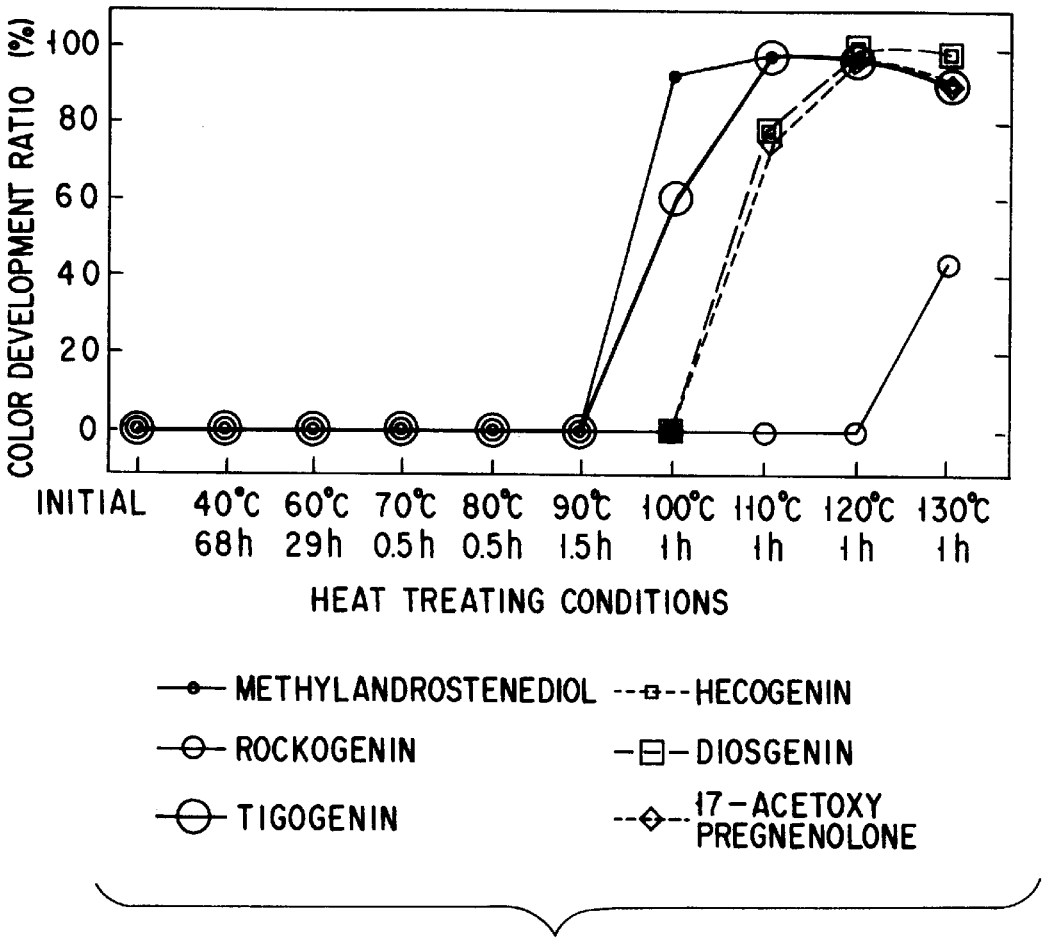
FIG. 7 is a graph showing the relationship between the color developing ratio and the heat treating conditions in respect of the reversible thermal recording medium of the present invention.

FIG. 7 is a graph showing the test results in respect of the thermal stability under high temperatures. In this test, the sample was put in a decolored state and, then, subjected to a heat treatment under predetermined conditions. After the heat treatment, measured was a color development ratio, i.e., a ratio of the reflection density of the color developing portion of the sample to the saturated reflection density, so as to determine the thermal stability of the sample. In the graph of FIG. 7, the color development ratio is plotted on the ordinate, with the conditions of the heat treatment plotted on the abscissa. As apparent from FIG. 7, the severest heat treating condition which permits maintaining the printed picture image is the heating at 90° C. for 1.5 hours in the case of using methyl androstene diol as a reversible material. To be more specific, the printed picture image is erased in this case substantially completely after the heat treatment at 100° C. for one hour. On the other hand, any of the samples using reversible materials represented by the formulas (1), (A) and (B) was found to be superior in thermal stability to the sample using methylandrostenediol. Particularly, the sample using reckogenin as a reversible material was found to be capable of maintaining the printed image even after the heat treatment at 120° C. for one hour.

EXAMPLE 11

1 part by weight of Crystal Violet lactone as a color former, 1 part by weight of 2,4,4'-trihydroxybenzophenone as a developer, 5 parts by weight of hecogenin as a reversible material, and 15 parts by weight of 1-tetracosanol as a phase separation controller were blended and, then, heated to melt the composition to obtain a homogeneous molten composition. For reference, an additional composition was prepared as above, except that methylandrostenediol was used as a reversible material.

Figure 8:
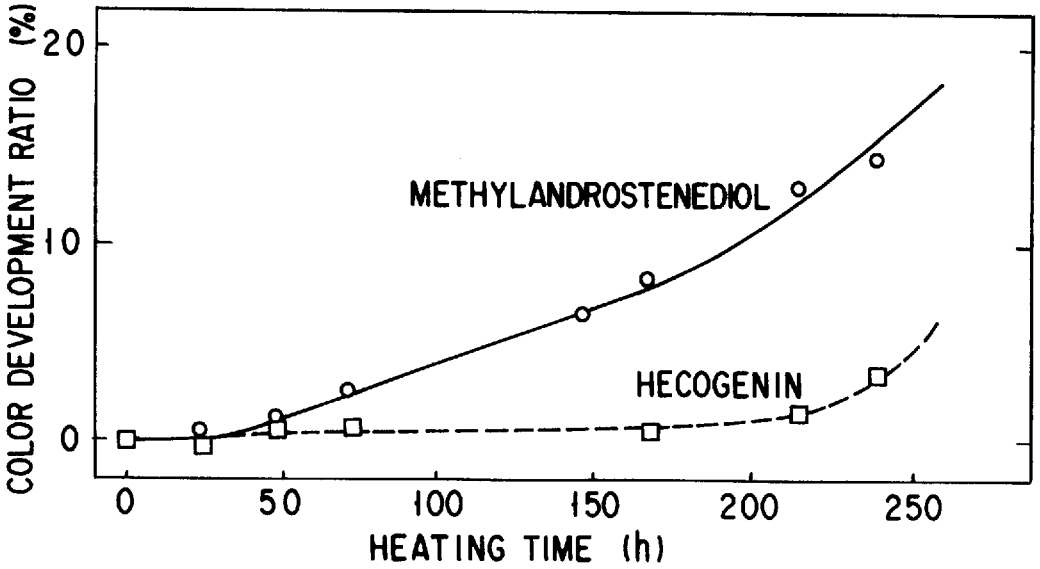
FIG. 8 is a graph showing the relationship between the color developing ratio and the heating time at 40° C. of the reversible thermal recording medium of the present invention.

Samples for testing the thermal stability, which were prepared as in Example 1, were stored at 40° C. so as to look into the relationship between the heating time and the color development ratio, with the results as shown in FIG. 8. As apparent from FIG. 8, the sample using hecogenin as a reversible material was found to be markedly superior in its thermal stability to the sample using methylandrostenediol.

Each of these compositions was heated on a hot plate so as to allow a neutral paper sheet (SZ base paper having a thickness of 25 μm, manufactured by Dai-Showa Seishi K.K.) to be impregnated with the heated composition. Then, the composition was melted by heating on the hot plate, followed by cooling to room temperature so as to turn the composition into a white decolored state. Further, samples for testing the color development speed were prepared by forming a PET film 5 μm thick as a protective film on the neutral paper sheet. Images were written in each of these samples by using a hot stamper at 150° C. at which color development was set to take place so as to evaluate the time required for reaching a saturated reflection density. Any of these samples was found to reach the saturated reflection density in 0.2 second, supporting that the color development speed was sufficiently high.

EXAMPLE 12

1 part by weight of Crystal Violet lactone as a color former, 1 part by weight of propyl gallate as a developer, 5 parts by weight of pregnenolone as a reversible material, and 5 parts by weight of various phase separation controllers shown in Table 3 were blended and, then, heated to melt the composition so as to obtain a homogeneous molten composition.

Samples for testing the thermal stability were prepared by disposing each of the resultant compositions between two glass plates such that the sample thus prepared was about 5 μm thick. Further, additional samples for testing a color development density, i.e., reflection density at the color developing step, were prepared by impregnating an SZ base paper sheet (neutral paper sheet referred to previously) with each of the resultant compositions, followed by laminating a PET film 5.7 μm thick on the impregnated SZ base paper sheet.

Figure 9:
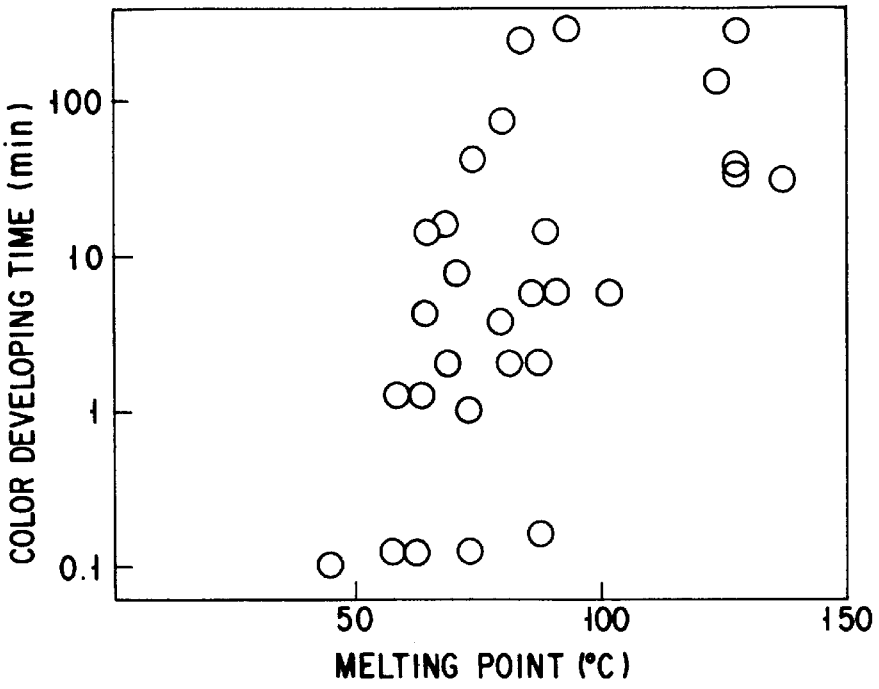
FIG. 9 is a graph showing the relationship between the time required for the color development to reach 10% when the reversible thermal recording medium of the present invention is stored at 40° C. and the melting point of the phase separation controller contained in the recording medium.

For performing the thermal stability test, the samples were stored at 40° C. so as to measure the time required for the color development ratio to reach 10%. FIG. 9 shows the results in terms of the relationship between the melting point of the phase separation controller and the logarithmic value of the time required for the color development ratio to reach 10%. Judging from the operating principle of the quaternary system, it is considered reasonable to understand that the thermal stability will be increased with increase in the melting point of the phase separation controller. However, the experimental data given in FIG. 9 fail to support that the melting point of the phase separation controller is deeply related to the thermal stability of the recording medium.

Figure 10:
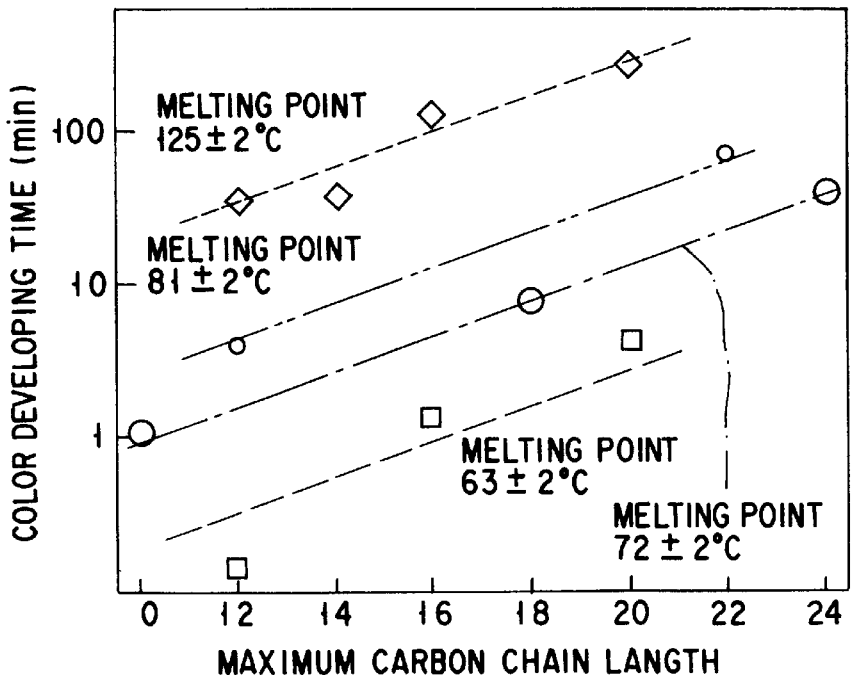
FIG. 10 is a graph showing the relationship between the time for the color development to reach 10% when the reversible thermal recording medium of the present invention is stored at 40° C. and the maximum carbon chain length included in the phase separation controller contained in the composition of the present invention, with the melting point of the phase separation controller used as a parameter.

Such being the situation, prepared was FIG. 10 showing the relationship between the maximum carbon chain length of the phase separation controller and the time required for the color development ratio to reach 10% using the melting point of the phase separation controller as a parameter. Table 3 shows the melting point and the maximum carbon chain length for each of the 11 phase separation controllers shown in FIG. 10. It is seen from FIG. 10 that the thermal stability of the recording medium is increased with increase in the maximum carbon chain length of the phase separation controller, where the phase separation controller has the same melting point.

TABLE 3

| No. | Phase separation controller | Melting Maximum point (°C.) | carbon chain length |
|---|---|---|---|
| 1 | dodecanedioic acid | 127 | 12 |
| 2 | tetradecanedioic acid | 127 | 14 |
| 3 | hexadecanedioic acid | 123 | 16 |
| 4 | elcosadecanedioic acid | 127 | 20 |
| 5 | 1,12-dodecanediol | 82 | 12 |
| 6 | behenic acid | 80 | 22 |
| 7 | 1,10-decanediol | 73 | 10 |
| 8 | stearic acid | 71 | 18 |
| 9 | 1-tetracosanol | 73 | 24 |
| 10 | palmitic acid | 63 | 16 |
| 11 | 1-elcosanol | 65 | 20 |

Where hydroxybenzophenones are used as a developer in place of propyl gallate, the thermal stability of the recording medium is also affected by the maximum carbon chain length of the phase separation controller, as in the case of using propyl gallate as a developer. It should be noted, however, that the melting point of hydroxybenzophenones is higher than that of propyl gallate and, thus, hydroxybenzophenones permit more effectively improving the thermal stability of the recording medium. It follows that a phase separation controller having a small maximum carbon chain length can be used in the case of using hydroxybenzophenones as a developer, compared with the case of using propyl gallate, where the resultant compositions are enabled to exhibit about the same thermal stability.

The color development density of the recording medium was measured by allowing each of the samples to generate color. In this test, the color development temperature was set higher by 5° C. than the melting point of the phase separation controller contained in the composition.

Figure 11:
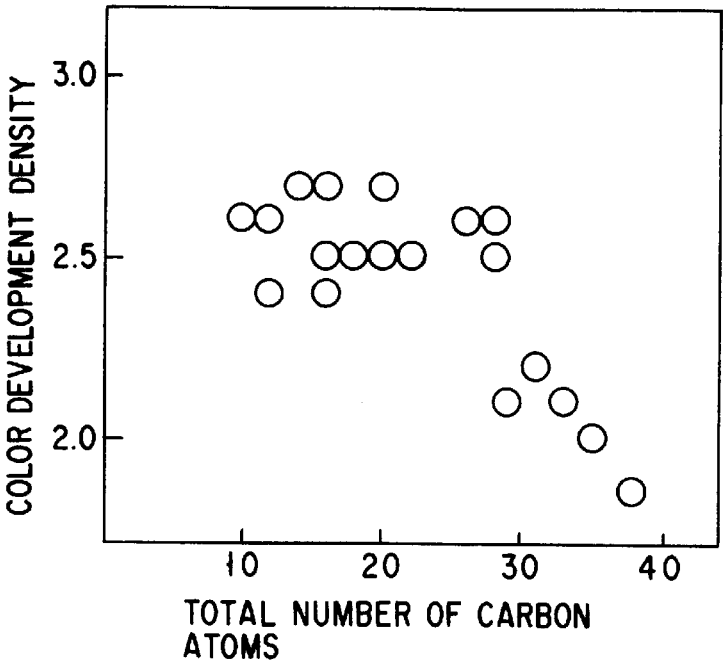
FIG. 11 is a graph showing the relationship between the color development density and the total number of carbon atoms in the phase separation controller contained in the reversible thermal recording medium of the present invention.

FIG. 11 shows the relationship between the total number of carbon atoms of the phase separation controller and the color development density. The experimental data given in FIG. 11 suggest that it is desirable for the total number of carbon atoms of the phase separation controller not to exceed 32 in order to obtain a high color development density, though a suitable value in respect of the total number of carbon atoms of the phase separation controller is somewhat dependent on the kind of the developer and the mixing ratio of the components of the composition.

Figure 12:
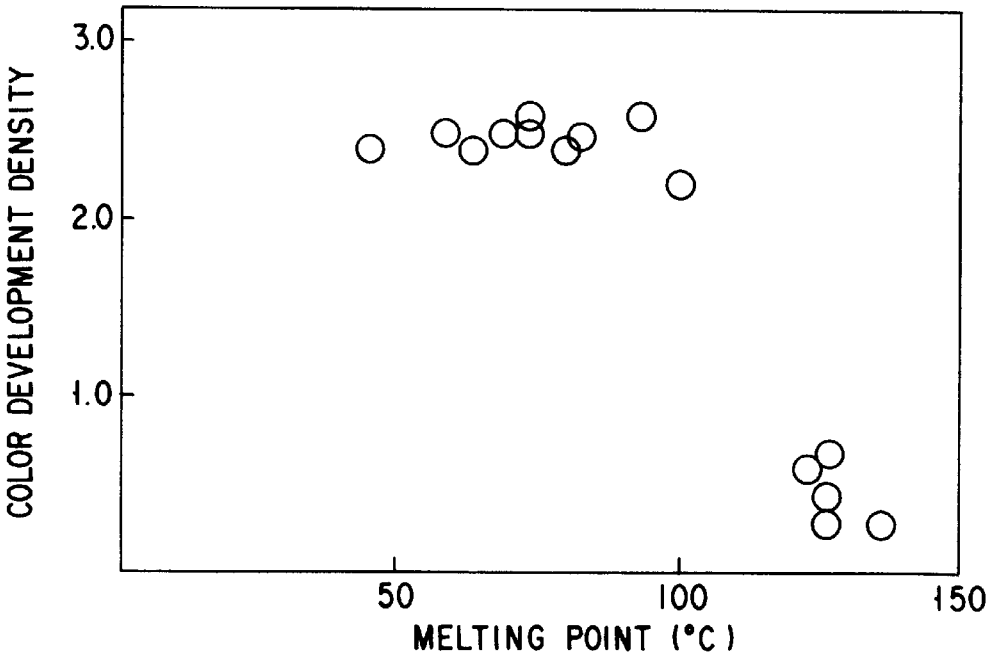
FIG. 12 is a graph showing the relationship between the color development density and the melting point of the phase separation controller contained in the reversible thermal recording medium of the present invention.

FIG. 12 is a graph showing the relationship between the melting point of the phase separation controller and the color development density, covering the case where the recording media used for the testing contained phase separation controllers having the total number of carbon atoms not exceeding 30. The graph clearly shows the color development density of the recording medium is abruptly lowered where the recording medium contains a phase separation controller having a melting point not lower than 120° C.

EXAMPLE 13

1 part by weight of Crystal Violet lactone as a color former, 1 part by weight of 2,2',4,4'-tetrahydroxybenzopnenone as a developer, 5 parts by weight of pregnenolone as a reversible material, and 3 to 30 parts by weight of 1-docosanol as a phase separation controller were blended and, then, heated to melt the composition so as to obtain a homogeneous molten composition.

Figure 13:
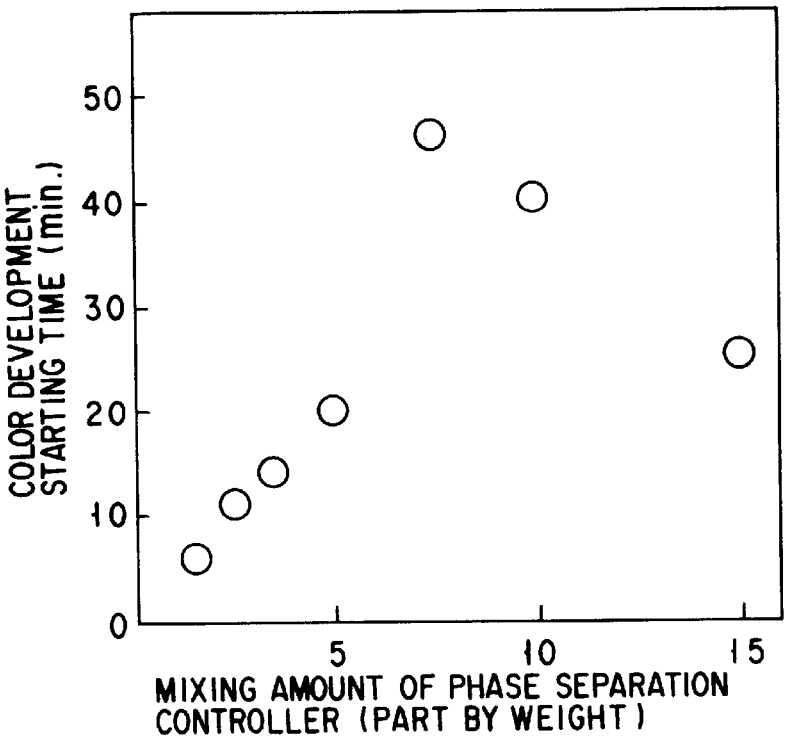
FIG. 13 is a graph showing the relationship between the color development starting time and the mixing ratio of the phase separation controller (1-docosanol) contained in the reversible thermal recording medium of the present invention.

Then, samples used for testing the thermal stability, which were prepared as in other Examples described herein previously, were stored at 40° C. so as to measure the time required for the sample to begin to generate color. FIG. 13 shows the relationship between the mixing amount (parts by weight) of 1-docosanol used as a phase separation controller relative to 1 part by weight of the developer and the time required for the recording medium to begin to generate color. The experimental data given in FIG. 13 clearly support that the composition containing about 7.5 parts by weight of the phase separation controller exhibits the highest thermal stability. It is also seen that a suitable amount of the phase separation controller falls within a range of between 5 and 15 parts by weight.

EXAMPLE 14

Various color formers, developers, reversible materials and phase separation controllers as shown in Tables 4 were blended and thermally melted to obtain homogeneous compositions.

Samples for testing the thermal stability of these compositions were prepared by sandwiching each of these compositions between two glass plates such that the sandwiched composition formed a layer having a thickness of about 5 μm. The thermal stability test was conducted at 40° C. so as to measure the color developing ratio of the sample a predetermined period of time later. Further, for measuring the color developing and decoloring speed, other samples were prepared by impregnating an SZ base paper sheet referred to previously with each of the compositions, followed by laminating a PET film 5.7μ thick on the impregnated base paper sheet. The color developing and decoloring speed was evaluated by estimation from the relationship between the stamping time measured by using a hot stamper of 100° to 150° C. and the color developing ratio. Each test was conducted a plurality of times. Table 4 also shows the results. As apparent from the Table 4, each recording medium was found to be short in its color developing and decoloring time, and satisfactory in its thermal stability at 40° C.

Further, each surface of the recording medium was coated with a photocurable silicone resin, followed by photocuring the resin so as to form a protective film having a thickness of 1 μm on each surface of the recording medium. The resultant sample was subjected to a color developing-decoloring test using a hot stamper, with the decoloring temperature set at 180° C. and the color developing temperature at 100° C. It was found possible to repeat color developing-decoloring cycles, with the cycle time of 0.3 second or less. Similarly, recording-erasing cycles of images were repeated, with the result that it was possible to carry out at least 100 cycles before the contrast ratio was lowered to half the original value.

TABLE 4

| | Color former [parts by weight] | Developer [parts by weight] | Reversible material [parts by weight] | Phase separation controller [parts by weight] | Color developing and decoloring time | Storage stability at 40° C. Storage time [hrs] | Storage stability at 40° C. Color developing ratio |
|---|---|---|---|---|---|---|---|
| Example 14-1 | crystal violet lactone [1] | 2,4,4'-trihydroxy-benzophenone | pregnenolone [5] | 1-octacosanol [5] | below 0.3 sec. | 24 | below 10% |
| Example 14-2 | crystal violet lactone [1] | 2,4,4'-trihdroxy-benzophenone [1] | pregnenolone [5] | 1-triacontanol [5] | below 0.3 sec. | 24 | below 2% |
| Example 14-3 | crystal violet lactone [1] | 2,4,4'-trihdroxy-benzophenone [1] | pregnenolone [5] | 1-octacosanol [5] | below 0.3 sec. | 24 | below 5% |
| Example 14-4 | crystal violet lactone [1] | 2,2'4,4'-tetorahydroxy-benzophenone [1] | pregnenolone [5] | 1-tetracosanol [5] | below 0.5 sec. | 24 | below 10% |
| Example 14-5 | crystal violet lactone [1] | 2,3,4,4'-tetorahydroxy-benzophenone [1] | pregnenolone [5] | 1-octacosanol [5] | below 0.3 sec. | 24 | below 5% |
| Example 14-6 | crystal violet lactone [1] | 2,4,4'-trihydroxy-benzophenone [1] | methylandro-stenediol [5] | 1-tetracosanol [5] | below 0.3 sec. | 100 | below 5% |
| Example 14-7 | crystal violet lactone [1] | 2,2',4,4'-tetrahydroxy-benzophenone [1] | methylandro-stenediol [5] | 1-octacosanol [5] | below 0.5 sec. | 24 | below 20% |
| Example 14-8 | crystal violet lactone [1] | methyl 2,3-dihydroxy-benzoate [1] | methylandro-stenediol [5] | 1-octacosanol [5] | below 0.3 sec. | 24 | below 10% |
| Example 14-9 | crystal violet lactone [1] | 4,4'-dihydroxy-banzophenone [1] | methylandro-stenediol [5] | 1-octacosanol [5] | below 0.3 sec. | 24 | below 10% |
| Example 14-10 | crystal violet lactone [1] | 2,4,4'-trihydroxy-benzophenone [1] | methylandro-stenediol [5] | 1-octacosanol [5] | below 0.3 sec. | 200 | below 2% |
| Example 14-11 | crystal violet lactone [1] | 2,4,4'-tetrahydroxy-benzophenone [1] | methylandro-stenediol [5] | 1-octacosanol [5] | below 0.3 sec. | 200 | below 20% |

EXAMPLE 15

The composition prepared in Example 14-6 was heated on a hot plate, followed by impregnating an SZ base paper sheet 25 μm thick with the heated composition. The resultant recording medium was heated on a hot plate so as to be melted, followed by cooling the molten recording medium to room temperature so as to put the recording medium in a white decolored state. When heated again on a hot plate to 90° C., the recording medium was put in a thin blue colored state. After the subsequent step of cooling to room temperature, the recording medium was colored deep.

EXAMPLE 16

1 part by weight of ETAC as a color former, 1 part by weight of 2,4,4'-trihydroxybenzophenone as a developer, 5 parts by weight of hecogenin as a reversible material, 5 parts by weight of 1,12-dodecanediol having a melting point of 82° C. as a phase separation controller, and 3 parts by weight of polytribromostyrene as a binder polymer were dissolved in a mixed solvent consisting of toluene and cyclohexanone. A recording layer 7 μm thick was formed by coating a substrate with the resultant solution. Further, a protective film of polyether-ether ketone (PEEK) having a thickness of 3.5 μm was laminated on the recording layer so as to prepare a thermal recording medium.

The color developing-decoloring properties of the thermal recording medium were evaluated by a TPH. To be more specific, the entire surface of the recording medium was put first in a decolored state by using a hot stamper, followed by successively heating the entire surface with a TPH for developing color. In the next step, the colored surface was selectively decolored with a TPH to form a predetermined pattern, thereby recording an image. The decoloring was performed by applying a sufficient voltage, with the recoading velocity fixed at 10 ms/L and the duty at 50%. Then, color development was selectively applied to the decolored pattern alone. During the color developing step, the applied voltage was changed, with the recoading velocity fixed at 20 ms/L and the duty at 70%, so as to look into the range of color development.

Figure 14:
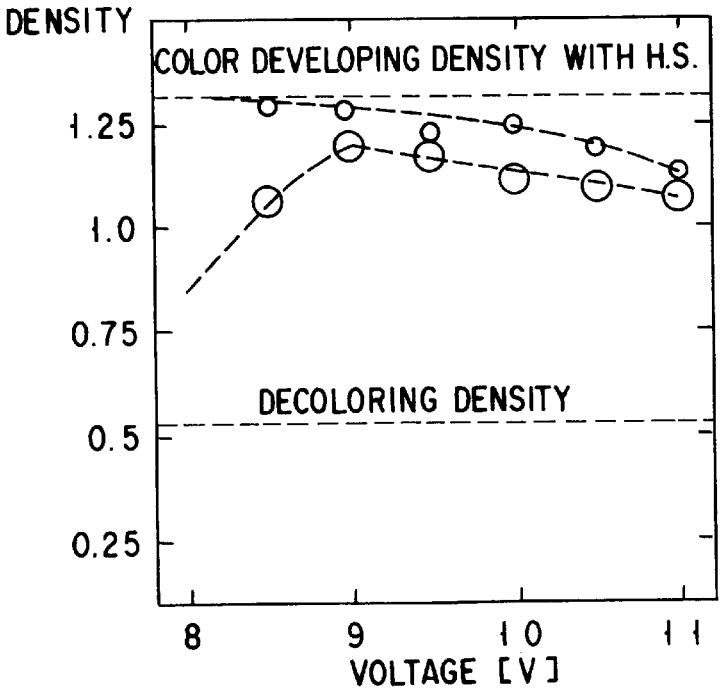
FIG. 14 is a graph showing the color development density achieved by over-writing in respect of the reversible thermal recording medium of the present invention.

FIG. 14 is a graph showing the results. The upper curve in FIG. 14 denotes the reflection density of the background relative to the voltage, covering the case where color was developed from a decolored state. On the other hand, the lower curve denotes the reflection density relative to the voltage, covering the case where the decolored pattern after the color development was subjected again to color development. As apparent from the graph, the reflection density of the color-developed background substantially coincides with the reflection density in the case of color-developing the decolored pattern, supporting that the decolored pattern can be erased in practice. It follows that it is possible to perform overwriting with a TPH.

Figure 15:
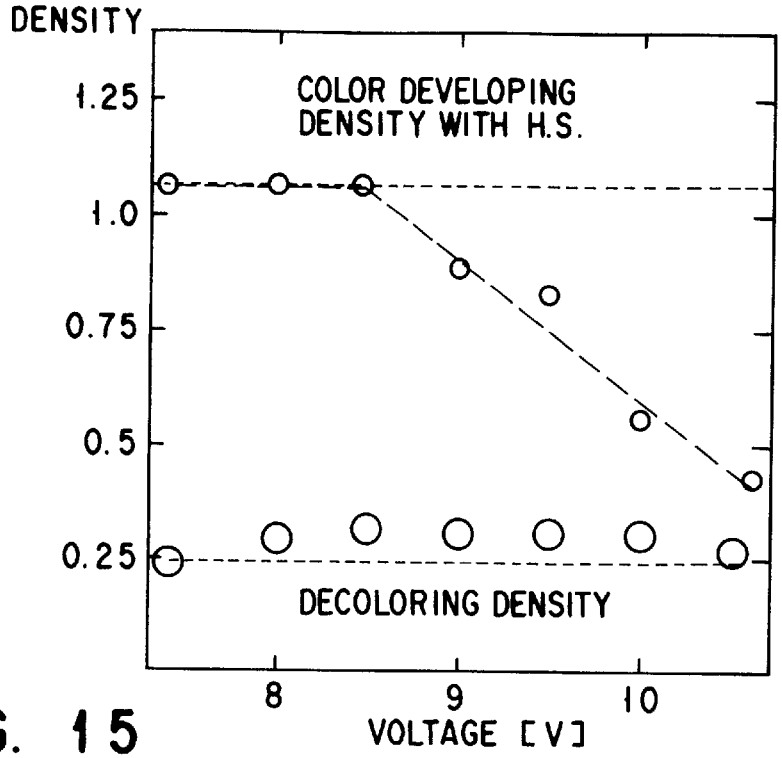
FIG. 15 is a graph showing the color development density achieved by over-writing in respect of the conventional recording medium.

For comparison, an additional thermal recording medium was prepared as above, except that used were 1 part by weight of CVL as a color former, 1 part by weight of 2,4,4'-trihydroxybenzophenone as a developer, 5 parts by weight of methylandrostenediol as a reversible material, 5 parts by weight of 1-tetracosanol as a phase separation controller, and 3 parts by weight of styrene-methacrylic acid copolymer as a binder polymer. The color developing-decoloring properties were also measured similarly, with the results as shown in FIG. 15. In this case, the color development was scarcely recognized when the decolored pattern was heated with a TPH over the entire region of voltage ranging between 7.5 V and 10.5 V, leading to a large difference in density from the color-developed background. In other words, the decolored pattern fails to be erased completely, resulting in failure to perform overwriting.

In the experiment described above, the reflection density of the background where color was developed with a TPH was found to be 90% or less of the reflection density in the case of using a hot stamper (stamping time of 0.2 second) for developing the color. In other words, the saturated reflection density is increased in general with increase in the heat treating time at relatively low temperatures. Such being the situation, the color developing density achieved with a TPH was normalized by the color developing density achieved with a hot stamper so as to evaluate the color developing sensitivity achieved with a TPH. The normalized color developing ratio was found to be 70% for Example 16 and only 8% for the comparative example described above.

EXAMPLE 17

Table 5 shows normalized color developing ratio of various compositions. The compounds of color formers are denoted by CAS Nos. in Table 5. As apparent from Table 5, any of the compositions tested was found to exhibit 60 to 90% of the normalized color developing ratio under the recoading velocity of 20 ms/L.

TABLE 5

| Color former by CAS number [parts by weight] | Developer [parts by weight] | Reversible material [parts by weight] | Phase separation controller [parts by weight] | Nomalized color developing ratio at 20ms/L [%] |
|---|---|---|---|---|
| 55250-84-5 [1] | 2,4,4'-trihydoxy-benzophenone [1] | hecogenin [5] | 1,12-dodecanediol [5] | 85 |
| 129473-78-5 [1] | propyl gallate [1] | hecogenin [5] | 1,12-dodecanediol [5] | 60 |
| 129473-78-5 [1] | 2,4-dihydroxy-benezophenone [1] | hecogenin [5] | 1,12-dodecanediol [5] | 60 |
| 129473-78-5 [1] | 4,4'-dihyroxy-benezophenone [1] | hecogenin [5] | 1,12-dodecanediol [5] | 62 |
| 129473-78-5 [1] | 4-[(4-hydroxyphonyl)methyl]-1,2,3-benzenetriol [1] | hecogenin [5] | 1,12-dodecanediol [5] | 78 |
| 129473-78-5 [1] | 2,3,4,4'-tetrahydroxy-benezophenone [1] | hecogenin [5] | 1,12-dodecanediol [5] | 67 |
| 129473-78-5 [1] | 2,4,4'-trihydoxy-benezophenone [1] | hecogenin [7] | 1,12-dodecanediol [3] | 73 |
| 129473-78-5 [1] | 2,4,4'-trihydoxy-benezophenone [1] | hecogenin [11] | 1,12-dodecanediol [3] | 84 |
| 129473-78-5 [1] | 2,4,4'-trihydoxy-benzophenone [1] | hecogenin [7] | 1,14-tetradecanediol [3] | 74 |
| 69898-40-4 [1] | 2,4,4'-trihydoxy-benzophenone [1] | hecogenin [5] | 1,12-dodecanediol [5] | 87 |

TABLE 5-continued

| Color former by CAS number [parts by weight] | Developer [parts by weight] | Reversible material [parts by weight] | Phase separation controller [parts by weight] | Nomalized color developing ratio at 20ms/L [%] |
|---|---|---|---|---|
| 69898-40-4 [1] | 2,4,4'-trihydoxy-benzophenone [1] | hecogenin [7] | 1,12-dodecanediol [3] | 83 |
| 69898-40-4 [1] | 2,4,4'-trihydoxy-benzophenone [1] | hecogenin [7] | 1,12-dodecanediol [7] | 79 |
| 69898-40-4 [1] | 2,4,4'-trihydoxy-benzophenone [1] | hecogenin [11] | 1,12-dodecanediol [3] | 85 |
| 69898-40-4 [1] | 2,4,4'-trihydoxy-benzophenone [1] | hecogenin [10] | 1,14-tetradecanediol [10] | 80 |
| 69898-40-4 [1] | 2,4,4'-trihydoxy-benezophenone [1] | hecogenin [7] | 1,20-eicosanediol [3] | 69 |
| 55250-84-5 [1] | 2,4,4'-trihydoxy-benezophenone [1] | hecogenin [7] | 1,12-dodecanediol [3] | 79 |
| 92409-09-1 [1] | 2,4,4'-trihydoxy-benezophenone [1] | hecogenin [7] | 1,12-dodecanediol [3] | 84 |
| 50292-91-6 [1] | 2,4,4'-trihydoxy-benezophenone [1] | hecogenin [7] | 1,12-dodecanediol [3] | 83 |

EXAMPLE 18

1 part by weight of 3-(4-diethylamino-2-ethoxyphenyl)-3-(1-ethyl-2-methylindol-3-yl)-4-azaphthalide as a color former, 1 part by weight of 2,4,4'-trihydroxybenzophenone as a developer, 7 parts by weight of 5-pregnene-3β, 17-diol-20-one-3-acetate as a reversible material, 3 parts by weight of 1,12-dodecanediol (melting point of 82° C.) as a phase separation controller, and 3 parts by weight of polytribromostyrene as a binder polymer were dissolved in a mixed solvent consisting of toluene and cyclohexanone. A recording layer about 7 μm thick was formed by coating a substrate with the resultant solution. Further, a PEEK protective film 3.5 μm thick was laminated on the recording layer so as to prepare a thermal recording medium.

Figure 16:
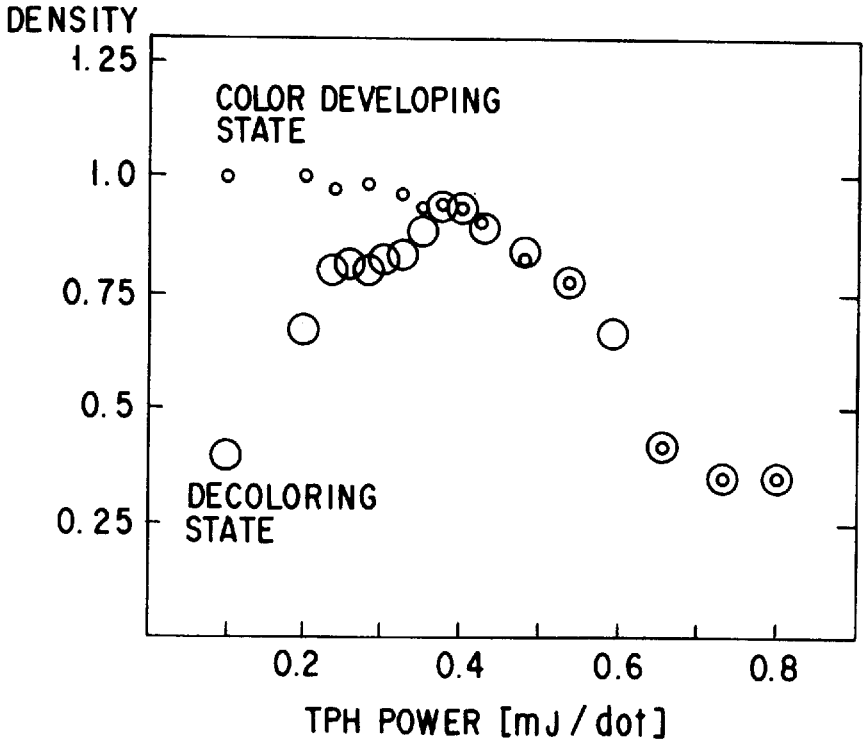
FIG. 16 is a graph showing the color development density achieved by over-writing in respect of the reversible thermal recording medium of the present invention.

The resultant thermal recording medium was subjected to evaluation of the color developing and decoloring using a TPH as in Example 16. The decoloring was achieved by applying a sufficiently high voltage, with the recoading velocity fixed at 3 ms/L and the duty at 50%. On the other hand, the color development was performed by changing variously the voltage applied to the sample, with the recoading velocity fixed at 3 ms/L and the duty at 70%, so as to determine the range of voltage within which color can be developed. FIG. 16 shows the results. In this experiment, the normalized color developing ratio was found to be as high as 90% or more in spite of the recoading velocity set at such a high value as 3 ms/L, supporting that the recording medium was capable of a high speed response to the heating with a TPH.

EXAMPLE 19

1 part by weight of Crystal Violet lactone as a color former, 1 part by weight of 2,4,4'-trihydroxybenzophenone as a developer, 5 parts by weight of methylandrostenediol as a reversible material, 4 parts by weight of 1-triacontanol (melting point of 87° C.) as a phase separation controller, and 1 part by weight of 1-tetracosanol (melting point of 73° C.) also as a phase separation controller were blended and thermally melted to obtain a homogeneous composition. It should be noted that a difference between the melting point and the solidifying point is 10° C. or more in the mixed phase separation controller and, thus, the mixed material is capable of supercooling.

For comparison, two additional homogeneous compositions were prepared as above, except that 5 parts by weight of 1-triacontanol alone was used as the phase separation controller in one comparative composition, with 5 parts by weight of 1-tetracosanol alone being used as the phase separation controller in the other comparative composition.

Each of the resultant compositions was heated on a hot plate, followed by impregnating an SZ base paper sheet with the heated composition. Then, the impregnated base paper sheet was heated to melt the impregnating composition, followed by cooling to room temperature to put the impregnated sheet in a white decolored state. Further, a protective film consisting of a PET film 5 μm thick was formed on the recording medium so as to obtain a sample for testing.

Images were written in the sample using a hot stamper, with the color developing temperature set at 150° C., so as to measure the time required for reaching a saturated reflection density. In the comparative sample using 1-triacontanol alone or 1-tetracosanol alone as the phase separation controller, the saturated reflection density was found to be reached in 0.2 second. On the other hand, in the sample using both 1-triacontanol and 1-tetracosanol as the phase separation controller, the saturated reflection density was found to be reached in 0.1 second. In other words, the image-writing speed in the sample of Example 19 was found to be at least 2 times as high as that in the comparative samples.

EXAMPLE 20

1 part by weight of Crystal Violet lactone as a color former, 1 part by weight of 2,4,4'-trihydroxybenzophenone as a developer, 5 parts by weight of methylandrostenediol as a reversible material, 4 parts by weight of 1-docosanol (melting point of 69° C.) as a phase separation controller, and 3 parts by weight of behenic acid (melting point of 80° C.) also as a phase separation controller were blended and thermally melted to obtain a homogeneous composition. It should be noted that a difference between the melting point and the solidifying point is 10° C. or more in the mixed phase separation controller and, thus, the mixed material is capable of supercooling, though these two compounds differ from each other in the polar group.

For comparison, two additional homogeneous compositions were prepared as above, except that 5 parts by weight of 1-docosanol alone was used as the phase separation controller in one comparative composition, with 5 parts by weight of behenic acid alone being used as the phase separation controller in the other comparative composition.

A sample for testing was prepared as in Example 19 using each of these compositions.

Images were written in the sample using a hot stamper, with the color developing temperature set at 150° C., so as to measure the time required for reaching a saturated reflection density. In the comparative sample using 1-docosanol alone as the phase separation controller, the saturated reflection density was found to be reached in about 0.2 second. Further, in the other comparative sample using behenic acid alone as the phase separation controller, the saturated reflection density was found to be reached in about 2 seconds. On the other hand, in the sample using both 1-docosanol and behenic acid as the phase separation controller, the saturated reflection density was found to be reached in 0.1 second. In other words, the image-writing speed in the sample of Example 20 was found to be at least 2 times as high as that in the comparative samples.

EXAMPLE 21

1 part by weight of Crystal Violet lactone as a color former, 1 part by weight of 2,4,4'-trihydroxybenzophenone as a developer, 5 parts by weight of methylandrostenediol as a reversible material, and 5 parts by weight of a phase separation controller prepared by removing the low molecular components having carboxyl groups from NPS9210 (trade name of trihydric alcohol-based wax manufactured by Nippon Seiro K.K.) were blended and thermally melted to obtain a homogeneous composition. The difference between the melting point and the solidifying point of the phase separation controller noted above, which is considered to be a mixture containing as main components various kinds of linear higher alcohols, is 10° C. or more. Therefore, the phase separation controller was capable of supercooling.

A sample for testing was prepared as in Example 19 using each of the resultant composition. Images were written in the sample using a hot stamper, with the color developing temperature set at 150° C., so as to measure the time required for reaching a saturated reflection density. In the resultant sample, the saturated reflection density was found to be reached in 0.1 second.

EXAMPLE 22

Reversible thermal recording media were prepared as in Examples 19 to 21 using various compounds shown in Table 7 as phase separation controllers. Images were written in the sample using a hot stamper, with the color developing temperature set at 150° C., so as to measure the time required for reaching a saturated reflection density. The saturated reflection density was found to be reached in 0.1 second in any of the samples tested.

TABLE 6

| | Phase separation controller | | | |
|---|---|---|---|---|
| Example | first component (80 wt %) | melting point (°C.) | second component (20 wt %) | melting point (°C.) |
| 22-1 | 1-triacontanol | 87 | n-docosanamide | 104 |
| 22-2 | 1-triacontanol | 87 | stearamide | 109 |
| 22-3 | 1-triacontanol | 87 | stearin | 70 |
| 22-4 | 1-tetracosanol | 74 | n-docosanamide | 104 |
| 22-5 | 1-tetracosanol | 74 | 2-cetyleicosanol | 48 |
| 22-6 | 1-docosanol | 69 | 1,12-octadecanediol | 80 |
| 22-7 | 1-docosanol | 69 | 1,16-hexadecanediol | 92 |
| 22-8 | 1-docosanol | 69 | dodecanedioic acid | 127 |
| 22-9 | 1-docosanol | 69 | erucamide | 81 |

What is claimed is:

1. A reversible thermal recording medium, comprising a composition containing a color former, a developer, and a reversible material capable of reversibly changing the state of said composition by supplying heat energies with two different values or by providing two different heat histories, at least 80% by weight of said reversible material being a sterol compound in which the carbon-to-carbon bond between 2- and 3-positions of the steroid skeleton represented by structural formula (1) given below is a single bond, the carbon-to-carbon bond between 3- and 4-positions of said steroid skeleton is a single bond, a hydroxyl group is attached to the carbon atom in at least the 3-position of the steroid skeleton, and at least one of chemical structures (A) to (D) given below is bonded at 16- and 17-positions of the steroid skeleton:

(1)

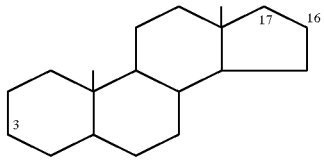

(steroid skelton)

(A)

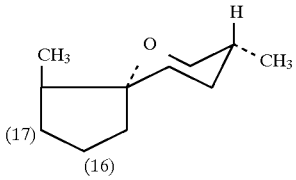

(B)

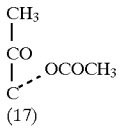

(C)

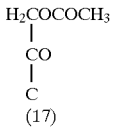

(D)

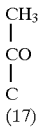

2. The reversible thermal recording medium according to claim 1, wherein said composition further contains a phase separation controller which permits changing the phase separation speed of said color former or said developer at temperatures in the vicinity of the melting point of said phase separation controller, said phase separation agent being highly crystallizable, having a low molecular weight and comprising a long-chained alkyl group having a minimum carbon chain length of 10 and at least one polar group.

3. The reversible thermal recording medium according to claim 2, wherein said phase separation controller is contained in an amount of 1 to 50 parts by weight relative to 1 part by weight of said developer.

4. The reversible thermal recording medium according to claim 2, wherein said phase separation controller is a linear, aliphatic alcohol having at least one hydroxyl group.

5. The reversible thermal recording medium according to claim 2, wherein said phase separation controller is a linear, aliphatic diol having hydroxyl groups attached to the carbon atoms at both ends of the carbon chain.

6. The reversible thermal recording medium according to claim 2, wherein said phase separation controller has at most 36 carbon atoms.

7. The reversible thermal recording medium according to claim 2, wherein said phase separation controller has a melting point of 70° C. to 120° C.

8. The reversible thermal recording medium according to claim 1, wherein said developer is contained in an amount of 0.1 to 10 parts by weight relative to 1 part by weight of said color former.

9. The reversible thermal recording medium according to claim 1, wherein said reversible material is contained in an amount of 1 to 200 parts by weight relative to 1 part by weight of said developer.

10. The reversible thermal recording medium according to claim 9, wherein said reversible material is contained in an amount of 3 to 30 parts by weight relative to 1 part by weight of said developer.

11. A reversible thermal recording medium, comprising a composition consisting of a color former, a developer and a phase separation controller which permits changing the phase separation speed of said color former or said developer at temperatures in the vicinity of the melting point of said phase separation controller, said phase separation controller being highly crystallizable, having a low molecular weight and comprising a long-chained alkyl group having a minimum carbon chain length of 10 and at least one polar group.

12. The reversible thermal recording medium according to claim 11, wherein said composition further contains a reversible material.

13. The reversible thermal recording medium according to claim 11, wherein said phase separation controller is a linear aliphatic alcohol having at least one hydroxyl group.

14. The reversible thermal recording medium according to claim 13, wherein said phase separation controller is a linear aliphatic diol having hydroxyl groups attached to the carbon atoms at both ends of the carbon chain.

15. The reversible thermal recording medium according to claim 11, wherein said phase separation controller has at most 36 carbon atoms.

16. The reversible thermal recording medium according to claim 11, wherein said phase separation controller has a melting point falling within a range of between 70° C. and 120° C.

17. A reversible thermal recording medium, comprising a composition containing a color former, a developer, and a reversible material, said reversible material being provided by a benzophenone compound represented by general formula (2) given below:

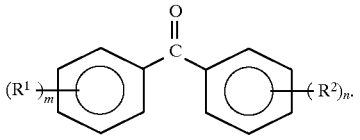

(2)

where $R^1$ and $R^2$, which are the same or different, are selected from the group consisting of a halogen atom, an alkyl group, an alkoxy group, an amino group and a hydroxyl group, and m and n, which are the same or different, denote integers of 0 to 5, at least one of $R^1$ and $R^2$ being a hydroxyl group, and at least one of m and n not being zero, said composition further containing a phase separation controller which permits changing the phase separation speed of said color former or said developer at temperatures in the vicinity of the melting point of said phase separation controller, said phase separation agent being highly crystallizable, having a low molecular weight and comprising a long-chained alkyl group having a minimum carbon chain length of 10 and at least one polar group.

18. The reversible thermal recording medium according to claim 17, wherein said phase separation controller is a linear, aliphatic alcohol having at least one hydroxyl group.

19. The reversible thermal recording medium according to claim 17, wherein said phase separation controller is a linear, aliphatic diol having hydroxyl groups attached to the carbon atoms at both ends of the carbon chain.

20. The reversible thermal recording medium according to claim 17, wherein said phase separation controller has at most 36 carbon atoms.

21. The reversible thermal recording medium according to claim 17, wherein said phase separation controller has a melting point of 70° C. to 120° C.

22. A reversible thermal recording medium, comprising a composition containing a color former, a developer provided by a benzophenone compound having a phenolic hydroxyl group, a reversible material provided by a steroid compound in which the carbon-to-carbon bond between 2- and 3-positions of the steroid skeleton is a single bond, the carbon-to-carbon bond between 3- and 4-positions of said steroid skeleton is a single bond, and both a hydroxyl group and a —$OCOCH_3$ group are attached to the carbon atom in the 3-position of the steroid skeleton, and a phase separation controller provided by a highly crystallizable, low molecular weight linear aliphatic diol having hydroxyl groups attached to the carbon atoms at both ends of the carbon chain having a minimum carbon chain length of 10.

23. A reversible thermal recording medium, comprising a composition consisting of a color former, a developer, a reversible material, and a phase separation controller, the difference between the melting point and the solidifying point of said phase separation controller being at least 10° C., said phase separation agent being highly crystallizable, having a low molecular weight and comprising a long-chained alkyl group having a minimum carbon chain length of 10 and at least one polar group.

24. The reversible thermal recording medium according to claim 23, wherein said phase separation controller is a mixture of at least two different compounds.

* * * * *